US007866953B2

(12) United States Patent
Johnston

(10) Patent No.: US 7,866,953 B2
(45) Date of Patent: Jan. 11, 2011

(54) FLUID PUMP

(76) Inventor: Barry Woods Johnston, 2423 Pickwick Rd., Baltimore, MD (US) 21207

( * ) Notice: Subject to any disclaimer, the term of this patent is extended or adjusted under 35 U.S.C. 154(b) by 907 days.

(21) Appl. No.: 11/577,265

(22) PCT Filed: Oct. 14, 2005

(86) PCT No.: PCT/US2005/036532

§ 371 (c)(1),
(2), (4) Date: Apr. 13, 2007

(87) PCT Pub. No.: WO2006/044387

PCT Pub. Date: Apr. 27, 2006

(65) Prior Publication Data

US 2008/0085198 A1 Apr. 10, 2008

Related U.S. Application Data

(60) Provisional application No. 60/618,749, filed on Oct. 15, 2004.

(51) Int. Cl.

| | |
|---|---|
| ***F04B 49/00*** | (2006.01) |
| ***F04B 43/12*** | (2006.01) |
| ***F04B 39/06*** | (2006.01) |
| ***F04B 43/076*** | (2006.01) |

(52) U.S. Cl. ..... 417/46; 417/53; 417/228; 417/395

(58) Field of Classification Search ..... 417/46, 417/53, 228, 375, 380, 393, 395, 392; 60/670
See application file for complete search history.

(56) References Cited

U.S. PATENT DOCUMENTS

| | | | | |
|---|---|---|---|---|
| 3,513,659 | A * | 5/1970 | Martini | 62/6 |
| 4,502,848 | A | 3/1985 | Robertson et al. | |
| 5,615,643 | A | 4/1997 | Hill | |
| 5,720,177 | A * | 2/1998 | Derrick et al. | 62/115 |
| 6,302,653 | B1 * | 10/2001 | Bryant et al. | 417/53 |
| 6,505,691 | B2 * | 1/2003 | Judge et al. | 175/70 |
| 7,171,810 | B2 * | 2/2007 | Conrad | 60/517 |

* cited by examiner

*Primary Examiner*—Charles G Freay
(74) *Attorney, Agent, or Firm*—Lowe Hauptman Ham & Berner LLP

(57) ABSTRACT

A fluid pump for moving a fluid from a first fluid source of the fluid in a low pressure state to a second fluid source of the fluid in a high pressure state, includes a chamber; a partitioning member displaceable in the chamber and dividing the chamber into first and second sub-chambers of varying volumes; the first sub-chamber having an opening controllably communicable with either the second fluid source or a third fluid source; the second sub-chamber having inlet and outlet openings controllably communicable with the first and second fluid sources, respectively; and a cooling element for cooling a fluid in the first sub-chamber.

22 Claims, 14 Drawing Sheets

SINGLE FLUID VAPOR PUMP

Step 1

SINGLE FLUID VAPOR PUMP

Step 2

SINGLE FLUID VAPOR PUMP

Step 3

SINGLE FLUID VAPOR PUMP

Step 4

SINGLE FLUID VAPOR PUMP

Step 5

SINGLE FLUID VAPOR PUMP

Step 6

SINGLE FLUID VAPOR PUMP

Step 7

DOUBLE FLUID VAPOR PUMP

SINGLE FLUID VAPOR PUMP

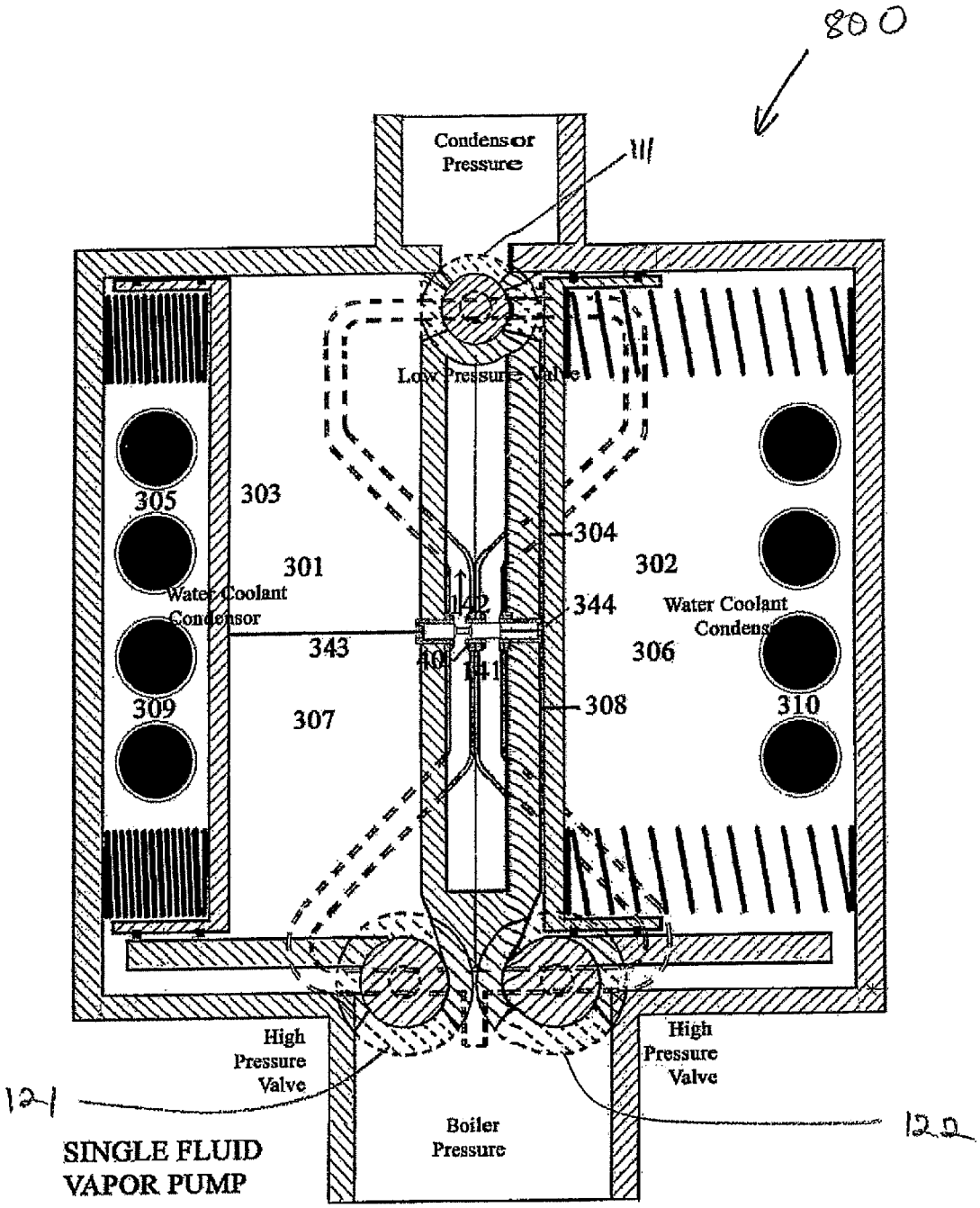

SINGLE FLUID VAPOR PUMP

This drawing shows a more compact arrangement of the components and valves so as to minimize the volume waste between the pistons and valves when the vapor pump pistons 303 and 304 are in their Top Dead Center (TDC) position. The other drawings are drawn to show the schematic relationship of the components so as to show the operation of the pneumatic system. The dotted lines of the valves show the valve openings.

Fig-8

FLUID PUMP

RELATED APPLICATIONS

The present Application for Patent is a National Phase entry of International Application Number PCT/US2005/036532, filed Oct. 14, 2005, which claims priority to U.S. Provisional Application No. 60/618,749 filed Oct. 15, 2004 the entireties of which are expressly incorporated by reference herein.

The entireties of related U.S. Pat. Nos. 4,698,973, 4,938,117, 4,947,731, 5,806,403, 6,505,538, U.S. Provisional Applications No. 60/506,141 and 60/618,749, and International Application PCT/US05/36180 entitled "MUTI-CYLINDER RECIPROCATING UNIFLOW ENGINE" filed in the USPTO as the Receiving Office on Oct. 7, 2005 are also incorporated herein by reference.

BACKGROUND

The described embodiments relate to a fluid pump, and more particularly, to a fluid pump for use in a thermal system with a boiler and a heat engine.

Is it known in thermodynamics that a heat engine requires the circulation of the working fluid from a cold sink or engine exhaust to a hot source such as a boiler. Fluid pumps are used for this purpose.

As is also well-known in the field, the Rankine Cycle usually used in such thermal systems requires a phase change to pass the working fluid from the low pressure level of the sink or engine exhaust to the high pressure level of the boiler. In other words, the low pressure vapor of the working fluid must be cooled to a liquid before it is pumped back into the high pressure level of the boiler for recycling. During the Rankine Cycle, the semi-saturated low pressure vapor after the engine exhaust must then be cooled using a condenser coil so that the vapor can change phase to the liquid state. The cooled liquid is subsequently pumped back into the high pressure boiler to be reheated again to the vapor state, thus requiring a phase change back from liquid to vapor. A great deal of additional heat input is required to reheat and re-vaporize this liquid to a vapor, causing a great deal of loss in the cycle's thermal efficiency.

SUMMARY

In an embodiment, a fluid pump is provided for moving a fluid from a first fluid source of said fluid in a low pressure state to a second fluid source of said fluid in a high pressure state, said fluid pump comprising a chamber; a partitioning member displaceable in said chamber and dividing said chamber into first and second sub-chambers of varying volumes; said first sub-chamber having an opening controllably communicable with either the second fluid source or a third fluid source; said second sub-chamber having inlet and outlet openings controllably communicable with the first and second fluid sources, respectively; and a cooling element for cooling a fluid in said first sub-chamber.

In a further embodiment, a fluid pump is provided for moving a fluid from a first fluid source of said fluid in a low pressure state to a second fluid source of said fluid in a high pressure state, said fluid pump comprising: first and second chambers; a first partitioning member displaceable in said first chamber and dividing said first chamber into first and second sub-chambers of varying volumes; a second partitioning member displaceable in said second chamber and dividing said second chamber into third and fourth sub-chambers of varying volumes; each of said first and fourth sub-chambers having an opening controllably communicable with either the second fluid source or a third fluid source; each of said second and third sub-chambers having inlet and outlet openings controllably communicable with the first and second fluid sources, respectively; and a cooling element for cooling a fluid in said first and fourth sub-chambers, thereby reducing the fluid pressures in said first and fourth sub-chambers and creating suctions in said second and third sub-chambers, respectively, for drawing the low pressure fluid from said first fluid source into said second and third sub-chambers, respectively; wherein said first fluid source is at all times in fluid communication with at least one of the second and third sub-chambers via the respective inlet openings, whereby the low pressure fluid is substantially continuously drawn out of the first fluid source.

In a further embodiment, a fluid pump is provided for moving a fluid from a first fluid source of said fluid in a low pressure state to a second fluid source of said fluid in a high pressure state, said fluid pump comprising: a chamber controllably communicable with the first and second fluid sources; locking element for communicating the chamber with only one of the first and second fluid sources at a time; and suction element for generating a suction in said chamber and drawing the low pressure fluid from said first fluid source into said chamber when said locking element communicates the chamber with the first fluid source and isolates said chamber from the second fluid source; said locking element being further for isolating the drawn low pressure fluid trapped in said chamber from the first fluid source, and then communicating the chamber with the second fluid source, thereby moving the trapped low pressure fluid to the second fluid source.

In a further embodiment, a system is provided to comprise a boiler for supplying a high pressure fluid; an engine coupled to said boiler, running on said high pressure fluid, and exhausting said fluid in a low pressure state; and a fluid pump for returning the low pressure fluid from the engine exhaust to said boiler, said fluid pump comprising: a chamber; a partitioning member displaceable in said chamber and dividing said chamber into first and second sub-chambers of varying volumes; said first sub-chamber having an opening controllably communicable with either the boiler or a further fluid source; said second sub-chamber having inlet and outlet openings controllably communicable with the engine exhaust and the boiler, respectively; and a cooling element for cooling a fluid in said first sub-chamber, thereby reducing the fluid pressure in said first sub-chamber and creating a suction in said second sub-chamber for drawing the low pressure fluid from said engine exhaust into said second sub-chamber from which said low pressure fluid is further moved to said boiler upon opening of said outlet opening.

In a further embodiment, a method is provided for pumping a fluid from a first fluid source of said fluid in a low pressure state to a second fluid source of said fluid in a high pressure state, said method comprising: providing a chamber having a partitioning member displaceable therein and dividing said chamber into first and second sub-chambers of varying volumes; cooling a fluidic medium in said first sub-chamber to reduce a pressure in said first chamber, causing the partitioning member to move to expand the second sub-chamber thereby generating a suction in the second sub-chamber; communicating said second sub-chamber with the first fluid source, thereby drawing the low pressure fluid into said second sub-chamber by the generated suction; isolating the second sub-chamber from said first fluid source and then communicating the second sub-chamber with the second fluid source, thereby causing the drawn low pressure fluid to move to the second fluid source without a phase change.

Additional aspects and advantages of the disclosed embodiments are set forth in part in the description which follows, and in part are obvious from the description, or may be learned by practice of the disclosed embodiments. The aspects and advantages of the disclosed embodiments may also be realized and attained by the means of the instrumentalities and combinations particularly pointed out in the appended claims.

BRIEF DESCRIPTION OF THE DRAWINGS

The described embodiments are illustrated by way of example, and not by limitation, in the figures of the accompanying drawings, wherein elements having the same reference numeral designations represent like elements throughout, and wherein elements having the same reference numeral designations represent like elements.

FIG. 8 is a schematically cross sectional view of a fluid pump in accordance with a further embodiment.

DETAILED DESCRIPTION

Figure 1:
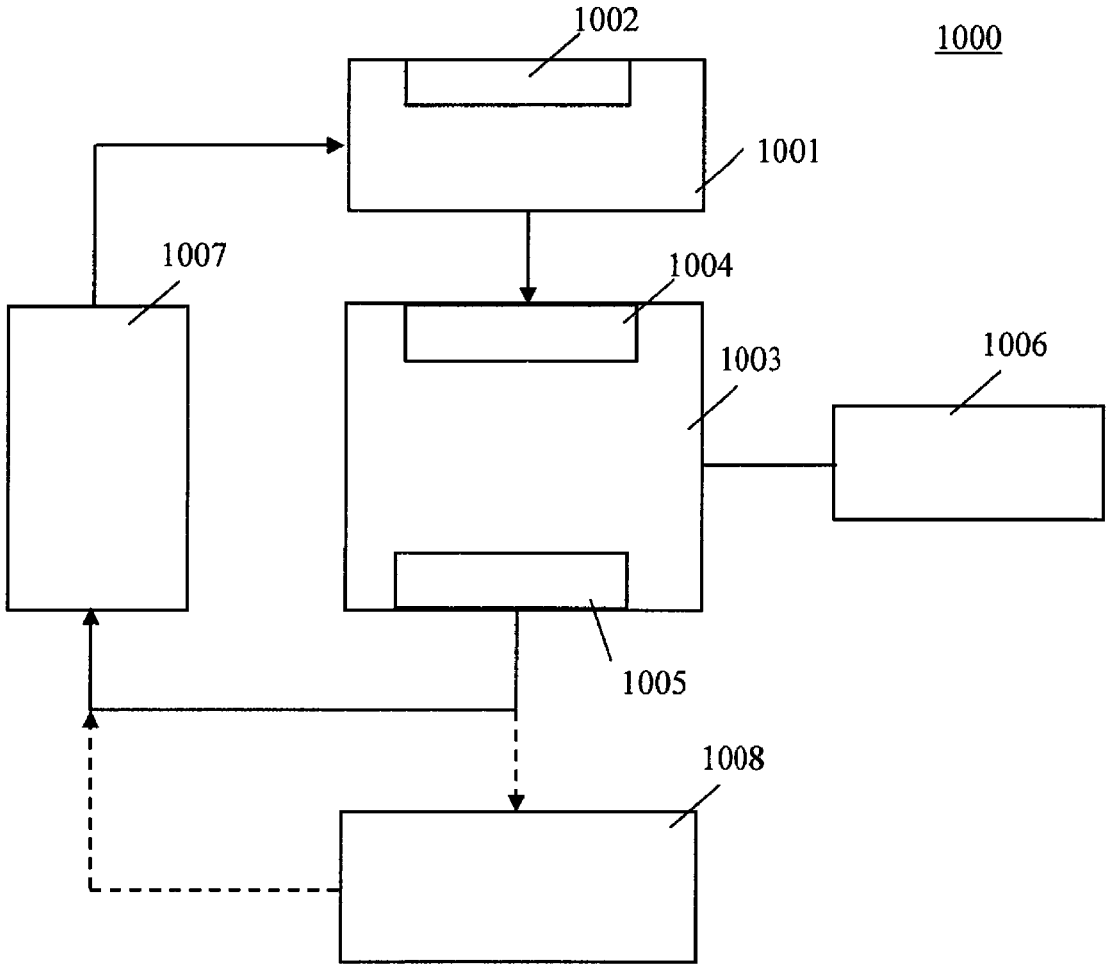
FIG. 1 is a schematic diagram of a thermal system in accordance with an embodiment.

In the following detailed description, for purposes of explanation, numerous specific details are set forth in order to provide a thorough understanding of the embodiments. It will be apparent, however, that the embodiments may be practiced without these specific details. In other instances, well-known structures and devices are schematically shown in order to simplify the drawing.

FIG. 1 is a schematic diagram of a thermal system 1000 in which a fluid pump in accordance with the disclosed embodiments is used. System 1000 in an embodiment includes a boiler 1001, an engine 1003, and a fluid pump 1007.

Boiler 1001 is a closed vessel in which a working fluid is heated, in an embodiment, under pressure. The steam or vapor of the heated working fluid, which is now in a high pressure state, is then circulated out of the boiler 1001 for use in engine 1003. The heat source 1002 for the boiler 1001 in an embodiment can be the combustion of any type of fossil fuels such as wood, coal, oil, natural gas. In a further embodiment, heat source 1002 can also be solar, electrical, nuclear or the like. The heat source 1002 can further be the heat rejected from other processes such as automobile exhausts or factory chimneys etc.

Engine 1003 is of a type that runs on the heated working fluid. As such, engine 1003 is a heat engine that converts energy of the heated working fluid to useful work, e.g., via output mechanism 1006 which can be a crank shaft or an electric generator or the like. The heated working fluid enters engine 1003 via inlet valve 1004 and exhausts from engine 1003 via exhaust or sink 1005. During the transfer of heat transferred from the boiler 1001 to the sink 1005, some of the heat is converted into useful work by output mechanism 1006. Examples of engine 1003 include, but are not limited to, multi-cylinder uni-flow engines disclosed in the patents and applications listed at the beginning of this specification, especially U.S. Pat. Nos. 5,806,403 and 6,505,538.

The working fluid used in the disclosed embodiments can be any type of working fluid that is usable in a heat engine. Examples include, but are not limited to, water, air, hydrogen, helium. In an embodiment, R-134 is used as the working fluid. In a further embodiment, helium at about 212° F. is utilized.

Fluid pump 1007 is provided to forcibly move the working fluid in a low pressure state from sink 1005 back to boiler 1001 which is in the high pressure state.

As discussed above, when the Rankine Cycle is used, a condenser 1008 is connected (phantom line in FIG. 1) downstream of sink 1005 to perform a phase change prior to passing the low pressure working fluid from sink 1005 to the high pressure level of the boiler 1001. In other words, the low pressure working vapor in sink 1005 is cooled in condenser 1008 to the liquid state before it is pumped back into the high pressure boiler to be reheated again to the vapor state. Thus, a great deal of additional heat input is required to reheat the condensed liquid to vapor, causing a great deal of loss in the cycle's thermal efficiency.

The fluid pumps of the embodiments described herein below allows for the use of the Stirling Cycle that does not require a phase change. Instead, the low pressure fluid semi-saturated vapor at the engine exhaust, i.e., in sink 1005, is allowed to pass, by fluid pump 1007, back to the high pressure of the boiler 1001 without a phase change, so that the vapor of the working fluid can again be used to drive the engine 1001. Because this occurs by sidestepping the above described phase change, the thermodynamic efficiency of the overall thermal system 1000 is boosted considerably. The fluid pump 1007 in accordance with the embodiments described herein below includes a Stirling Cycle means of passing the low pressure fluid vapor which is accumulated at the engine exhaust, i.e., sink 1005, back into the high pressure level of boiler 1001 without a phase change of the low pressure vapor into liquid. However, it should be noted that the fluid pumps of the disclosed embodiments are not limited to pumping only vapor; the fluid pumps of the disclosed embodiments can pump liquids and/or mixtures of liquid and vapor which are often found in engine exhaust 1005.

Figure 2:
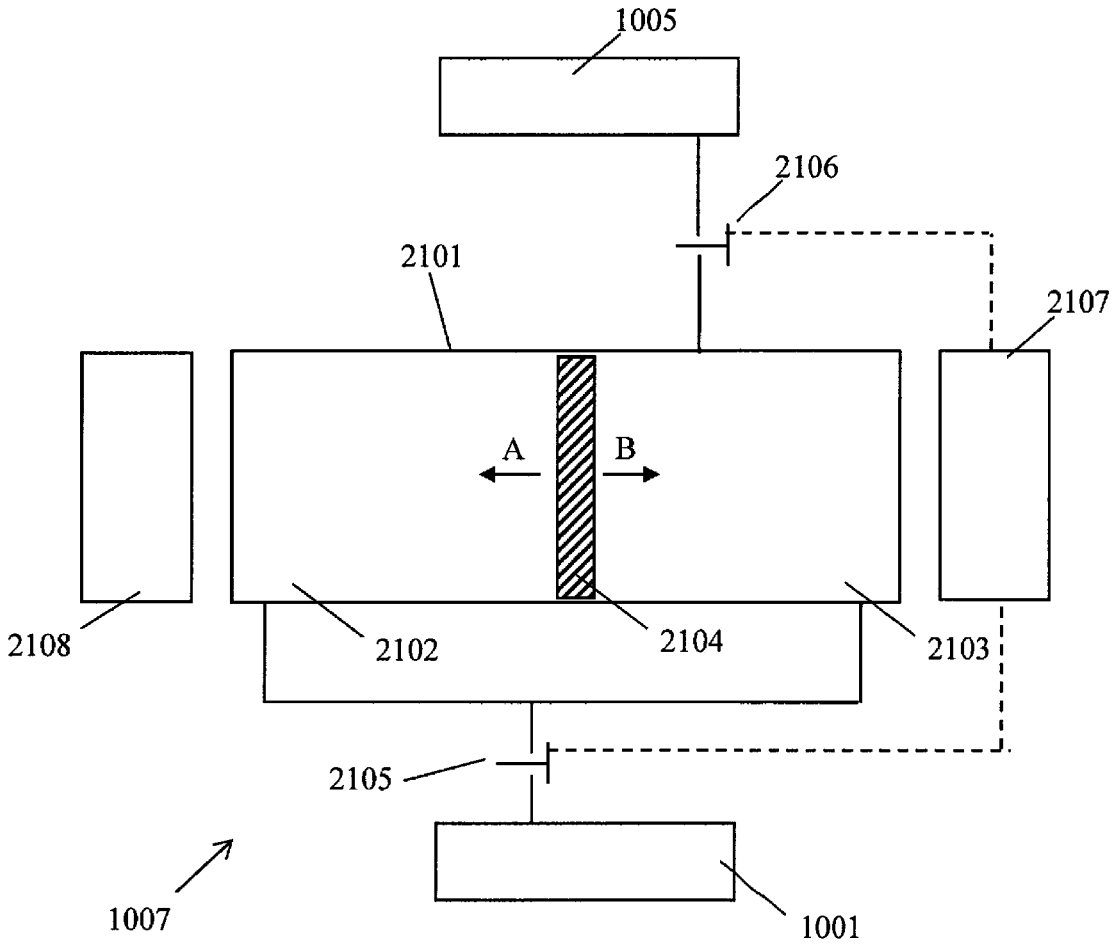
FIG. 2 is a schematic diagram of a fluid pump in accordance with a further embodiment.

FIG. 2 is a schematic diagram of fluid pump 1007 in accordance with an embodiment. Fluid pump 1007 includes a chamber 2101 divided into two sub-chambers 2102, 2103 by a displaceable partitioning member 2104. The first sub-chamber 2102 and second sub-chamber 2103 are communicable with boiler 1001 via a controllable opening which, in an embodiment, is closed/opened by outlet valve 2105. The second sub-chamber 2103 is further communicable with sink or engine exhaust 1005 via another controllable opening which, in an embodiment, is closed/opened by inlet valve 2106. The valves 2105, 2106 are controlled (phantom line in FIG. 2) by a valve control mechanism 2107. Fluid pump 1007 also includes a cooling system 2008 for cooling a fluidic medium in first sub-chamber 2102.

As will be described in more detail below, the low pressure vapor of the working fluid at engine exhaust 1005 is being sucked into second sub-chamber 2103. The volume of second sub-chamber 2103 expands with the displacement movement of partitioning member 2104. On the backside of the partitioning member 2104, the high pressure vapor from the boiler 1001 has been injected into the first sub-chamber 2102. The injected high pressure vapor is then isolated and condensed by cooling system 2108, creating a suction against the partitioning member 2104 and, hence, causing a suction action of the low pressure vapor from the condenser sink or engine exhaust 1005 into the second sub-chamber 2103. When second sub-chamber 2103 is full of the sucked low pressure vapor, the second sub-chamber 2103 is then isolated and both the sucked low pressure vapor in second sub-chamber 2103 and the condensed vapor in the first sub-chamber 2102 are opened to the high pressure vapor of the boiler 1001. The pressures on both sides of the partitioning member 2104 are equalized, allowing the partitioning member 2104 to return and compress the second sub-chamber 2103. Thus, a given volume of the low pressure vapor drawn from engine exhaust 1005 into second sub-chamber 2103 is replaced by the same volume of the high pressure vapor entering second sub-chamber 2103 from boiler 1001. As a result, a substantial portion of the working fluid in the given volume of the low pressure vapor will be transferred into the high pressure vapor side of the boiler 1001.

It should be noted that, the efficiency of the fluid pump 1007 is determined by $$\delta = Q1/(Q1+Q2)$$

where δ=efficiency, Q1=amount of heat required to raise a given mass of the low pressure vapor of the condenser sink or engine exhaust 1005 from its low pressure to the high pressure of the boiler 1001, and Q2=amount of heat required to cool an equivalent mass of the high pressure vapor from the boiler 1001 being consumed by the first sub-chamber 2102. In a non-limiting exemplary embodiment using helium at 212° F. and the Stirling Cycle, the efficiency is calculated as follows:

$$Q1 = \Delta h_{212^\circ} - h_{120^\circ}$$

$$Q2 = (d_{480\ psi} / d_{150\ psi}) \times (\Delta h_{212^\circ - h100^\circ})$$

$$\delta = Q1/(Q1+Q2)$$
$$= \Delta h_{212^\circ} - h_{120^\circ} \div [(d_{480\ psi} / d_{150\ psi}) \times \Delta h_{212^\circ} - h_{100^\circ} + \Delta h_{212^\circ} - h_{120^\circ}]$$

where δ=efficiency, $\Delta h_{212}{}^{\circ}$-$h_{120}{}^{\circ}$=heat required to raise a given mass of helium from 150 psi to 480 psi, $\Delta_{212}{}^{\circ}$-$h_{100}{}^{\circ}$=heat consumed cooling an equivalent mass of helium from 480 psi to 100 psi, and $d_{480\ psi}/d_{150\ psi}$=ratio of helium density at 480 psi and helium density at 150 psi.

It is worthwhile noting a well-known characteristic of a high pressure vapor, i.e., when that vapor is cooled, its volume decreases. Notably, when the vapor is cooled and converted to the liquid state, its volume decreases significantly. Depending on the type of working fluid being used as well as its pressure and temperature, the liquid volume of the working fluid may be as little as a few hundredths of its vapor volume.

One operational cycle of fluid pump 1007 will be now described with reference to FIG. 2. Assuming that the cycle begins with an opening of outlet valve 2105 (inlet valve 2106 remains closed) which allows the high pressure vapor from boiler 1001 to fill both first sub-chamber 2102 and second sub-chamber 2103. The pressures in first sub-chamber 2102 and second sub-chamber 2103 are equalized and, as a result, partitioning member 2104 assumes its initial position as shown in FIG. 2.

Next, outlet valve 2105 is closed, trapping an amount of high pressure vapor in first sub-chamber 2102. The cooling system 2108, which functions as a condenser, cools the trapped vapor of the working fluid to reduce its volume, and hence, pressure. In an embodiment, cooling system 2108 is configured to cool the trapped vapor of the working fluid to the liquid stare, thereby greatly reducing its volume and, hence, pressure in first sub-chamber 2102. As a result, partitioning member 2104 is moved, by the pressure difference between first sub-chamber 2102 and second sub-chamber 2103, to expand the volume of second sub-chamber 2103 as shown by arrow A in FIG. 2. Subsequently, the pressure of second sub-chamber 2103 is reduced due to its volume expansion.

Further, the inlet valve 2106 is opened while outlet valve 2105 remains closed. Since the pressure in second sub-chamber 2103 has been reduced due to its volume expansion, a suction force is created in second sub-chamber 2103 to draw the low pressure vapor from engine exhaust 1005 into second sub-chamber 2103. It should be noted that although the vapor at engine exhaust 1005 is called "low pressure vapor," its pressure must still be higher than that in the expanded second sub-chamber 2103 for the fluid pump 1007 to function properly. When the inlet valve 2106 is closed afterward, an amount of low pressure vapor is trapped in the second sub-chamber 2103.

The cycle will now return to the initial step, i.e., with the opening or outlet valve 2105 while keeping inlet valve 2106 closed. Again, the high pressure vapor from boiler 1001 will enter and fill both first sub-chamber 2102 and second sub-chamber 2103. In second sub-chamber 2103, equal volume exchange occurs, i.e., the trapped volume of low pressure vapor is replaced with the same volume of high pressure vapor from boiler 1001. As discussed above, such equal volume exchange will move a substantial portion of the trapped low pressure vapor to the boiler 1001. In first sub-chamber 2102, the entering high pressure vapor will supply the first sub-chamber 2102 with a new charge of high pressure vapor for the next cycle. The partitioning member 2104 will be moved, as shown by arrow B, by the pressure equalization to the initial position.

It should now be understood that the volume reduction of first sub-chamber 2102 due to the working fluid being cooled from the high pressure vapor state to the cooled liquid state is the driving force that sucks the low pressure vapor of the condenser sink 1005 into the second sub-chamber 2103, as discussed above.

It should now be further understood that the sucked volume from the low pressure of the condenser sink 1005 into the second sub-chamber 2103 can be passed onto the high pressure boiler pressure by an equal volume exchange action as described above.

It should be noted that although the high pressure vapor trapped in first sub-chamber 2102 can be, in some embodiments, cooled to the liquid state, i.e., undergoing a phase change, the low pressure vapor trapped in the second sub-chamber 2103 substantially remains its vapor state without undergoing a phase change. As a result, the working fluid is pumped from engine exhaust 1005 to boiler 1001 without a vapor-to-liquid phase change, thereby saving additional heat that would otherwise be necessary to reheat the cooled liquid to vapor again. In some further embodiments, the high pressure vapor (e.g., of helium) trapped in first sub-chamber 2102 will also be cooled without undergoing a phase change, in which case the cooled vapor in first sub-chamber 2102 will be dumped into boiler 1001 in a manner similar to the low pressure vapor trapped in second sub-chamber 2103. In some other embodiments using R-134a as the working fluid, there will be a phase change in first sub-chamber 2102 to maximize the suction in the second sub-chamber 2103.

It should be further noted that the valves 2105, 2106 and valve control mechanism 2107 in the above description circulation system work like the locking system of a canal lock. In particular, the high pressure lock valve (outlet valve 2105) closes before the low pressure lock valve (inlet valve 2106) opens and releases load (low pressure vapor from engine exhaust 1005) into the lock chamber (second sub-chamber 2103). Afterwards, the high pressure lock valve (outlet valve 2105) opens after the low pressure lock valve (inlet valve 2106) closes, thereby releasing the low pressure vapor trapped in the lock chamber (second sub-chamber 2103) to boiler 1001. Like in a canal lock, the lower pressure side (engine exhaust 1005) and the high pressure side (boiler 1001) are always isolated from each other.

The thermodynamic efficiency of the overall thermal system 1000 which uses a fluid pump in accordance with the above described embodiment and utilizes the Stirling Cycle is boosted considerably compared to when the Rankine cycle is used. The system efficiency is ç=W/Q, where as the consumption of the engine 1003 is the work output W and the required heat input is Q. In a very specific example, helium is used as the working fluid to drive both the engine 1003 and the fluid pump 1007, the volume reduction as it passes through the engine and cools from, e.g., 480 psi to approximately 100 psi is 2.482 times less. This means that approximately 2.5 times more volume must be pumped back into the boiler 1001 to maintain the equivalent mass circulating that is consumed by the engine 1003. This means that the volume displacement caused by the movement of the partitioning member 2104 must be approximately 2.5 times more than the volume consumed from the boiler 1001 for the engine 1003 in order to pump the equivalent amount of vapor back into the boiler 1001. In an embodiment, the cooling medium of the condenser 2108 in the fluid pump 1007 is water at approximately 57° F. The temperature range required would be from 212° F. to approximately 70° F., meaning that the pressure drop will be from about 480 psi to approximately 80 psi. This temperature drop will consume 180 Btu/lbm per stroke. Therefore, the total heat loss necessary to pump the same mass from the exhaust sink 1005 to the boiler 1001 would be 180 Btu/lbm× 2.482 or 447 Btus/lbs plus adding the heat that was consumed by the engine 1003, i.e., 142 Btu. The amount of heat that must be added to replenish the losses is 447 Btu/lbs plus 142 Btu or a total required heat input of 589 Btu/lbs. Noting that the heat loss of the engine 1003 is 142 Btu/lbm, if the engine efficiency is 85% and the fluid pump efficiency is 85%, the system efficiency, C=W/Q, will be (142/589)×(0.85)×(0.85) or 17.4%.

However, if R-134a is used, the volume reduction as it cools from 500 psi at 200° F. to 101 psi at 80° F. will be 7.09 times, meaning that the fluid pump 1007 must pump over 7 times to pass the equivalent amount of mass used by the engine 1003 during the pressure drop. The enthalpy loss by the engine 1003 is approximately 4.78 Btu/lbm. The heat loss driving the fluid pump 1007 would be 7.09×5.97 Btu/lbm or 42.327. If the engine efficiency is 85% and the fluid pump efficiency is 85%, the system efficiency for R134a, ç=W/Q, will be (4.78/47.11)×(0.85)×(0.85) or 7.33%. Even, if a conventional Rankine Cycle with regeneration (i.e., phase change) is used, it would have a difficult time achieving such an efficiency, considering that a conventional Rankine Cycle would suffer, at least, an 80 Btu loss due to the state change from vapor to a liquid, through regeneration and heat input. If using R-134a as the working fluid, an 80 Btu loss of a conventional Rankine Cycle compared to a 47.11 loss with the exemplary fluid pump would prove to achieve an 80/47.11 or 170% more efficient system.

Figure 3:
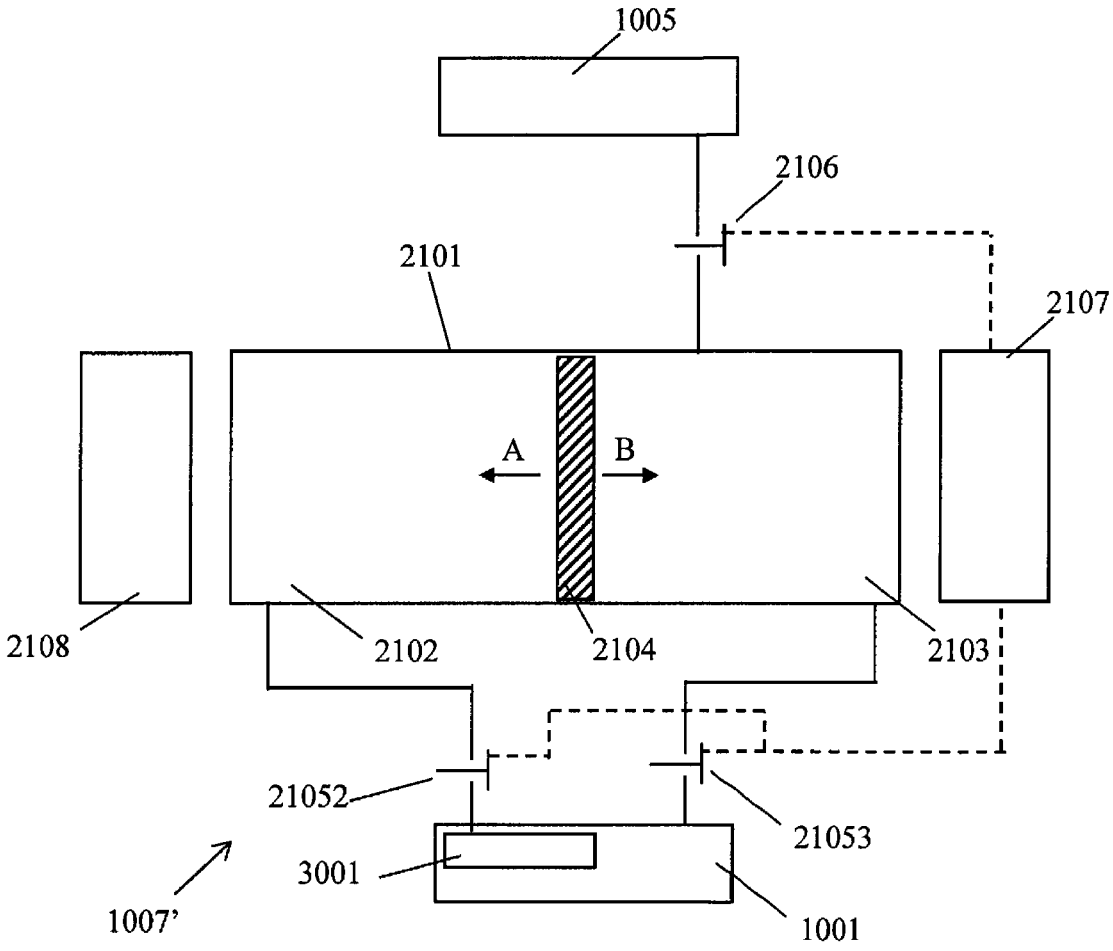
FIG. 3 is a schematic diagram of a fluid pump in accordance with a further embodiment.

FIG. 3 is schematic diagram of a fluid pump 1007' in accordance with a further embodiment. The fluid pump 1007' is similar to fluid pump 1007 of FIG. 2, except that an auxiliary boiler 3001 is provided and the controllable outlets of first sub-chamber 2102 and second sub-chamber 2103 are now separately controlled.

In particular, the common outlet valve 2105 of FIG. 2 is replaced in fluid pump 1007' of FIG. 3 with two outlet valves 21052 and 21053 for first sub-chamber 2102 and second sub-chamber 2103, respectively. The first sub-chamber 2102 is communicable with auxiliary boiler 3001 via outlet valve 21052, and the second sub-chamber 2103 is communicable with boiler 1001 via outlet valve 21053. The valves, namely inlet valve 2106 and outlet valves 21052 and 21053, are controlled by valve control mechanism 2107.

Although auxiliary boiler 3001 is shown in FIG. 3 as being located within or as part of boiler 1001, auxiliary boiler 3001 can be a separate boiler with the same heat source 1002 or a different heat source. A fluidic medium runs through the boiler coil of auxiliary boiler 3001, is heated and vaporized under pressure. Such fluidic medium can be the same as or other than the working fluid which is heated by boiler 1001 and on which engine 1003 runs.

In the particular embodiment shown in FIG. 3, auxiliary boiler 3001 is a boiler coil located within boiler 1001 and is heated by the same heat source 1002. Thus, the inner coil boiler 3001 will provide the working pressure for the minor inner system (cooling system 1008, first sub-chamber 2102) that drives the fluid pump 1007'. Locating this inner coil boiler 3001 inside the main boil 1001 insures that the working temperature will be the same for both the working fluid of boiler 1001 and the fluidic medium of auxiliary boiler 3001. The pressure in the inner coil boiler 3001, driving the minor inner system, in an embodiment, is equal to or greater than the pressure of the working fluid in the main boiler 1001. However, other arrangements are not excluded.

The reason for separating the fluidic medium used in the first sub-chamber 2102 and auxiliary boiler 3001 from the working fluid used in boiler 1001, second sub-chamber 2103 and engine 1003 is for flexibility of control. In particular, (1) the parameters of the main working fluid that drives the engine 1003 can be configured/controlled to provide optimum power output capability, whereas (2) the parameters of the fluidic medium of the minor inner system that drives fluid pump 1007' can be independently configured/controlled to provide optimum expansion and contraction capability between the temperature parameters with minimal BTU losses.

More specifically, the fluidic medium of auxiliary boiler 3001 can be chosen or, if it is the same as the working fluid of boiler 1001, configured to have parameters, such as temperature and/or pressure etc., other than those of the working fluid, to provide the desired volume reduction of first sub-chamber 2102, and hence, the desired suction force for drawing the low pressure vapor from engine exhaust 1005 into second sub-chamber 2103. During operation of the fluid pump 1007 of FIG. 2, if at least one of the parameters, e.g., temperature and/or pressure, of the working fluid is to be changed, the same parameter of the working fluid in first sub-chamber 2102 will be changed accordingly, which might not be desirable as resulting in excessive or insufficient suction forces. However, in the fluid pump 1007' of FIG. 3, the parameter of the fluidic medium in first sub-chamber 2102 and auxiliary boiler 3001 need not be changed in response to the parameter change in boiler 1001 and engine 1003, or can be controlled independently of the working fluid of boiler 1001 and engine 1003 to ensure that desirable and sufficient suction forces are always available in second sub-chamber 2103.

The operation of fluid pump 1007' is substantially similar to fluid pump 1007 and will not be repeated herein. It suffices to note that in the fluid pump 1007 of FIG. 2, the first sub-chamber 2102 and second sub-chamber 2103 are simultaneously communicated with boiler 1001 upon opening of the common outlet valve 2105. However, in the fluid pump 1007' of FIG. 3, the outlet valves 21052 and 21053 can be controlled by control mechanism 2107 to open with a slight delay therebetween, allowing adjustment of the pumping action of second sub-chamber 2103 and/or cooling action of first sub-chamber 2102.

It is within the scope of the present invention to replace both first sub-chamber outlet valve 21052 and second sub-chamber outlet valve 21053 in the fluid pump 1007' of FIG. 3 with a common outlet valve, such as 2105 of the fluid pump 1007 of FIG. 2. Such an embodiment simplifies the pump construction, but the fluidic medium of auxiliary boiler 3001 and the working fluid of 1001 will be mixed, which might not be desirable in some applications.

It should be noted that in the above described embodiments, there are intervals in the operational cycles where inlet valve 2106 is closed. As a result, the low pressure vapor is not withdrawn from engine exhaust 1005 during such intervals. This might not be desirable, especially in a multi-cylinder engine disclosed, e.g., in the above listed patents and applications, where there is always one of the cylinders that is on the downstroke and releases low pressure vapor to engine exhaust 1005. Thus, it is desirable to provide a fluid pump that substantially continuously pumps the low pressure vapor from engine exhaust 1005 to the high pressure level of boiler 1001. FIGS. 4A-4G show such a fluid pump.

Specifically, FIGS. 4A-4G are cross sectional views of fluid pump 400 in operation. The fluid pump 400 includes two similar halves divided by the imaginary central axis 401. Each half corresponds to one of the fluid pump 1007 described above with respect to FIG. 2. In other words, fluid pump 400 includes two similar fluid pump 1007 working in tandem.

Figure 4A:
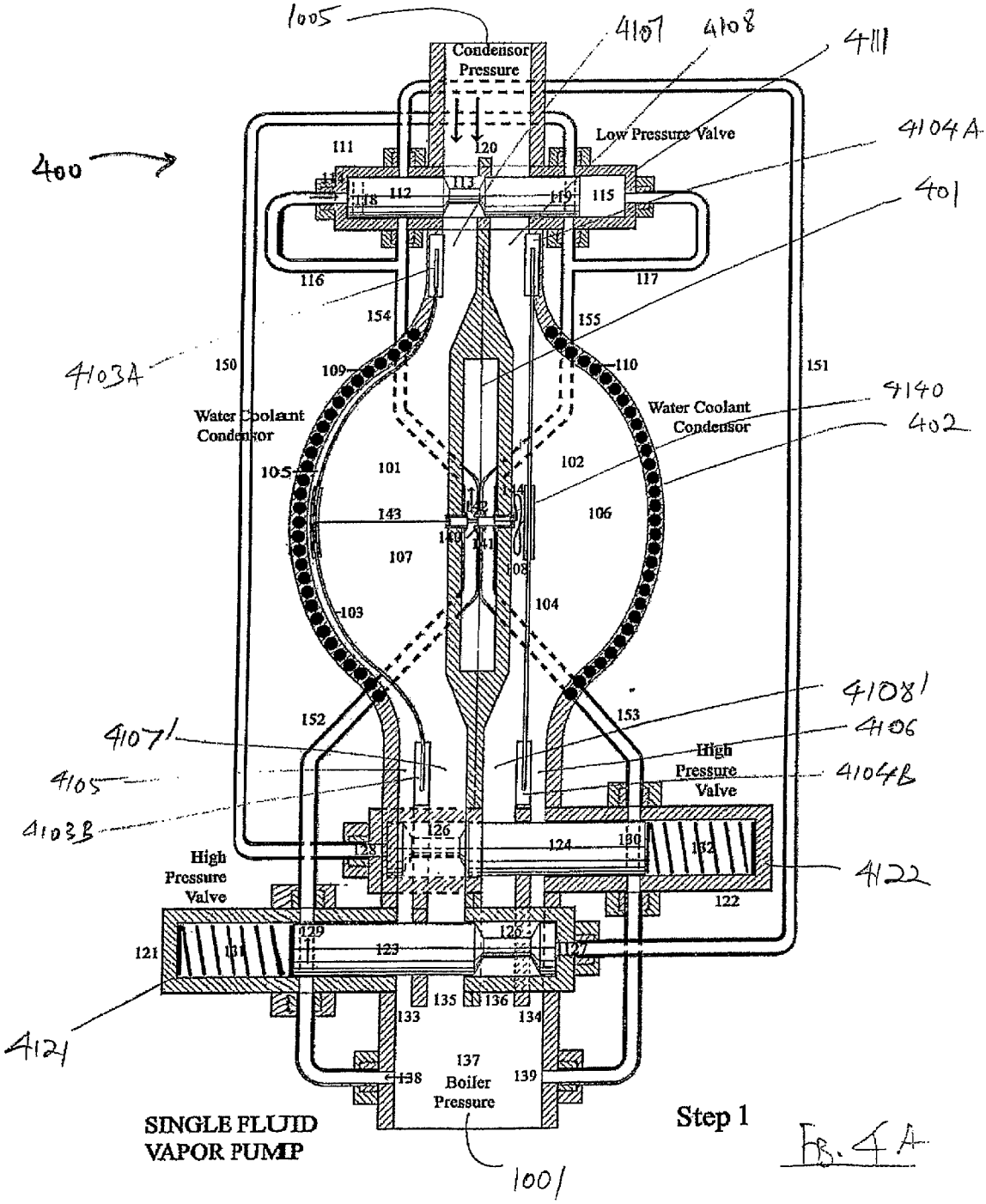
FIGS. 4A-4G are cross sectional views of a fluid pump in accordance with a further embodiment.

More specifically, as shown in FIG. 4A, fluid pump 400 includes a chamber 402 which, in turn, includes two halves 101, 102. Each half 101, 102 is divided by a moveable partitioning member 103, 104, respectively, into first sub-chamber 105, second sub-chamber 107, third sub-chamber 108, and fourth sub-chamber 106. The sub-chambers have varying volumes due to displacement so the respective partitioning members 103, 104. In this embodiment, partitioning members 103, 104 are diaphragms which are fixed at opposite ends 4103A, 4103B, 4004A and 4104B to the wall of chamber 402. The partitioning members 103, 104 correspond to partitioning member 2104 of fluid pump 1007. A plurality tubes 109, 110 which contain water, air or any other suitable cooling medium are disposed on opposite sides of chamber 402 and in thermal contact with first sub-chamber 105 and fourth sub-chamber 106 which correspond to first sub-chamber 2102 of fluid pump 1007. The tubes 109, 110 play the role of cooling system or condenser 2108. The second sub-chamber 107 and third sub-chamber 108 are equivalent to second sub-chamber 2103 of fluid pump 1007.

The upper portions of second sub-chamber 107, third sub-chamber 108 have controllable openings 4107, 4108 which are alternatively opened/closed by a common inlet valve 111. Inlet valve 111 includes a valve body 112 slidable within a valve housing 4111 and having a reduced cross section portion 113. The reduced cross section portion 113, when aligned with opening 4107 or 4108 will open the opening and communicate the respective second sub-chamber 107 or third sub-chamber 108 with engine exhaust 1005. As can be seen in FIGS. 4A-4G, at least one of openings 4107, 4108 is in fluid communication with engine exhaust 1005 at all times, therefore ensuring substantially continuous pumping of low pressure vapor from engine exhaust 1005. The inlet valve 111 plays the role of inlet valve 2106 of fluid pump 1007. The valve body 112 further includes through holes 118, 119 at opposite ends thereof. The holes 118, 119 will be described herein below with reference to other figures.

The lower portions of second sub-chamber 107, third sub-chamber 108 have controllable openings 4107', 4108' which are opened/closed by outlet valves 121, 122, respectively. Each of the outlet valves 121, 122 includes a valve body 123, 124 slidable within a valve housing 4121, 4122, and having a reduced cross section portion 125, 126. The reduced cross section portion 125, 126, when aligned with the respective opening 4107', 4108' will open the opening and communicate the respective second sub-chamber 107 or third sub-chamber 108 with boiler 1001. The outlet valves 121, 122 correspond to outlet valve 2105 of fluid pump 1007. The valve body 123, 124 further include through holes 129, 130 at end portions thereof. The outlet valves 121, 122 each further comprises a returning spring 131, 132 for closing the outlet valves shortly after their opening. The holes 129, 130 and springs 131, 132 will be described herein below with reference to other figures.

The upper portions of first sub-chamber 105, fourth sub-chamber 106 are sealed by the positioning of ends 4103A, 4104A of the respective partitioning members 103, 104 on the wall of chamber 402. The lower portions of first sub-chamber 105, fourth sub-chamber 106 have controllable openings 4105, 4106 which are also opened/closed by outlet valves 121, 122, respectively. The reduced cross section portion 125, 126, when aligned with the respective opening 4107', 4108', will be also aligned with openings 4105, 4106 of first sub-chamber 105, fourth sub-chamber 106 to simultaneously communicate both first sub-chamber 105, second sub-chamber 107 to boiler 1001 and both fourth sub-chamber 106, third sub-chamber 108 to boiler 1001. Other arrangements are not excluded.

Each of partitioning members 103, 104 is connected to a control valve 14U by strings 143, 144 to activate control valve 140 as will be described herein below. The control valve 140 includes a valve body 141 slidable within a valve housing 4140, and having a reduced cross section portion 142. The reduced cross section portion 142, when located in one of first duct 154 and second duct 155 extending through valve housing 4140, will open said duct and close the other. Thus, only one of first duct 154 and second duct 155 will be opened at a time.

Each of first duct 154 and second duct 155 communicate the high pressure level of boiler 1001 to one of the opposite sides 114, 115 of inlet valve 111 when the control valve 140 is in the respective opening position, and the outlet valves 121, 122 are in the closed position aligning the first duct 154, second duct 155 with respective holes 129, 130, as shown in FIG. 4A. The first duct 154, 155 further communicate the high pressure level of boiler 1001 to one of outlet valves 121, 122 via the respective hole 118, 119 of valve body 112 when the respective hole is aligned, by movement of inlet valve 111, with the first duct 154, or second duct 155. In FIG. 4A, second duct 155 is shown to communicate the high pressure level of boiler 1001 to outlet valve 122 via hole 119.

The operation of fluid pump 400 will now be described with reference to FIGS. 4A-4G. It should be noted that the last step, Step 7 (FIG. 4G), is a return to the first, Step 1 (FIG. 4A) of the cycle.

Step 1

As is shown in FIG. 4A, both outlet valves 121 and 122 between chambers 101 and 102 and boiler 1001 are closed. The reduced cross section portion 113 of inlet valve 111 communicates engine exhaust 1005 and second sub-chamber 107. The opening 4108 of third sub-chamber 108 is closed by inlet valve 111 to disconnect engine exhaust 1005 from third sub-chamber 108. Within the left chamber 101, the diaphragm 103 is shown stretched to the left. The open volume of second sub-chamber 107 to the right of the diaphragm 103 is filled with the low pressure vapor 120 which was sucked in from the engine exhaust sink 1005. The fluidic medium, in this case the working fluid of boiler 1001, in the first sub-chamber 105 on the left side of the diaphragm 103 has been cooled to its lowest desirable volume using the water cooling condenser system 109 in the left wall of the left fluid pump chamber 101.

It should be noted again that, in this particular embodiment, each valves 111, 121 and 122 has designed within it a canal valve or through hole 118, 119, 129 and 130 which is open only when the respective valve 111, 121 and 122 moves to its closed position. This is true with the two outlet valves 121 and 122 which are completely independent of one another. This is also true with the upper double inlet valve 111, which as a single unit, opens and closes the openings 4107, 4108 in tandem. Following the train of each of first duct 154 and second duct 155 and their tube sections 152, 153, 154, 155, 116, and 117 as it flows from the boiler 1001 to the respective pneumatic valves 111, 121, 122, it will be understood how each canal valve or through hole 118, 119, 129 and 130 accesses the high pressure vapor from the boiler 1001 to open/close the respective valves 111, 121 and 122.

Returning now to FIG. 4A, as stated above, the outlet valves 121, 122 are both closed while their canal valves 129, 130 are open. The high pressure vapor 138 is allowed to pass through the left canal valve 129 of the outlet valve 121 and then through the left opening of the diaphragm activated control valve 140 at the center of the device. This control valve 140 was opened earlier when the left diaphragm 103 was stretched to its left.

With respect to each respective chamber 101 and 102, each outlet valve 121 and 122 must always be closed when the respective side of the upper tandem inlet valve 111 is open, because the low pressure vapor 120 which is fed from the engine exhaust 1005 into the respective chamber second sub-chamber 107 and third sub-chamber 108 must be captivated therein its before that captivated volume can be dumped into the high pressure boiler 1001. Again, it should be noted that the valve system in the embodiments described herein works like the locking system of a canal lock.

In FIG. 4A, because the left side of the upper inlet valve 111 (i.e., opening 4107) is open, the respective canal valve 118 is closed. Therefore, the section 151 of first duct 154 that leads past the inlet valve 111 cannot access the boiler pressure 138 to open the lower left outlet valve 121 between the boiler 1001 and second sub-chamber 107.

The diaphragm 103 is completely stretched to the left allowing the volume of second sub-chamber 107 on the right to be completely filled with the low pressure vapor 120 from the engine exhaust sink 1005. This action of the left diaphragm 103 occurs, because of the suction caused on the left side of the diaphragm 103 (i.e., first sub-chamber 105). In particular, the hot injected working fluid from the boiler 1001 (or as will be described herein below in a double fluid fluid pump from the inner coil boiler 237) is cooled by the water or air cooling condenser 109. Note that, at the upper tandem inlet valve 111, the left side is open between the engine exhaust sink 1005 and the second sub-chamber 107, allowing the low pressure vapor 120 from the exhaust sink 1005 to flow to the second sub-chamber 107.

Also note that, when the diaphragm 103 in the left chamber 101 is stretched completely to the left, it pulls open (through the connection of the string 143) the diaphragm-activated valve 140 at the center of the fluid pump. Because the canal opening 129 of the pneumatic outlet valve 121 is open and the first duct 154 is open by control valve 140, the upper inlet valve 111 is able to receive the pressurized vapor 138 from the boiler 1001 that acts on the left side 114 of the upper inlet valve 111, causing the upper inlet valve 111 to slide to the right, thus closing the left side (i.e., opening 4107) of the tandem inlet valve 111. This brings us to Step 2.

Step 2

Figure 4B:
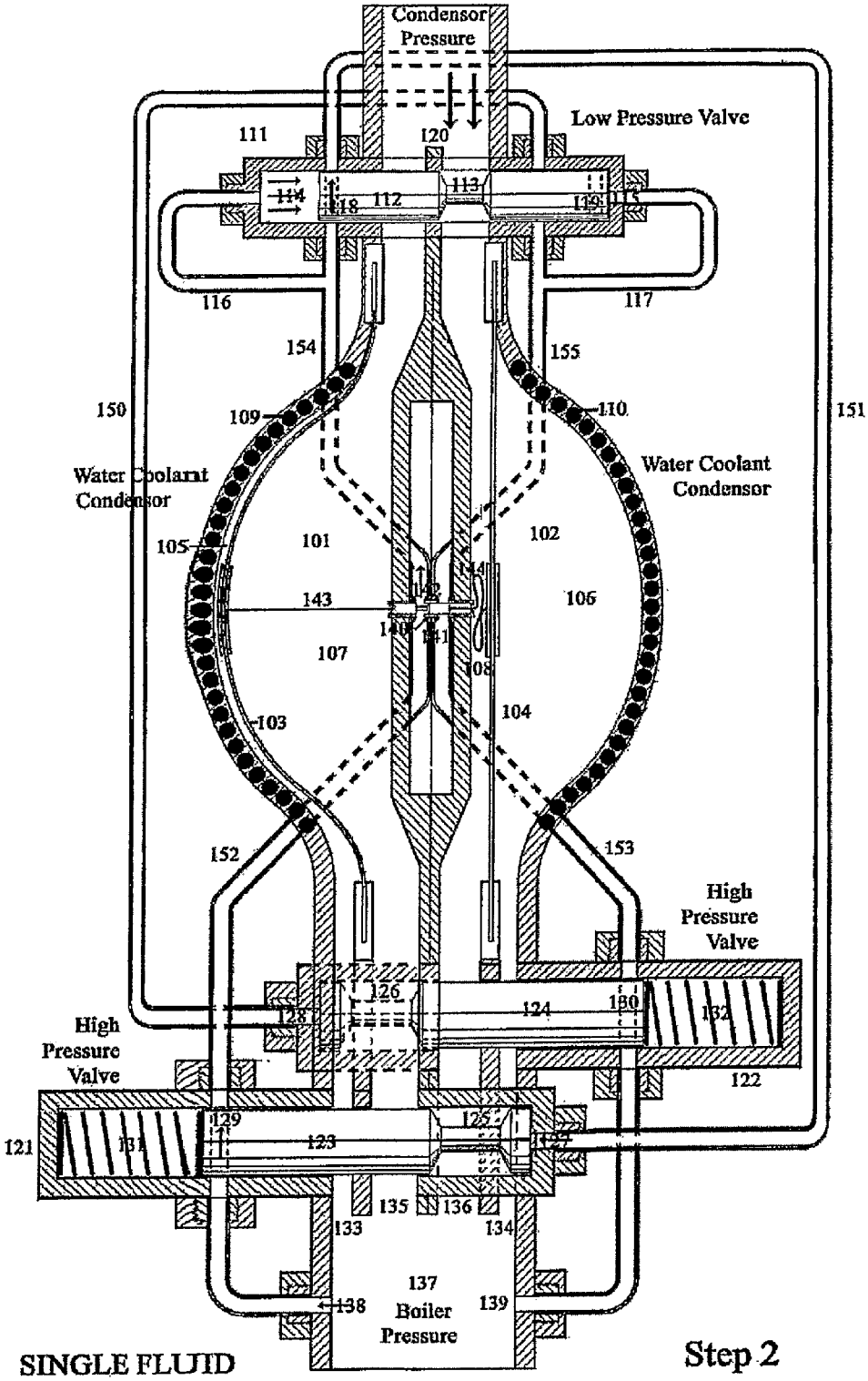

FIG. 4B shows that the boiler pressure 138 acting on the left side 114 of the upper inlet valve 111, forcing the inlet valve 111 to slide to the right, has thus opened the right side (i.e., opening 4108 of third sub-chamber 108) to communicate engine exhaust 1005 with third sub-chamber 108, while isolating second sub-chamber 107 of left chamber 101 from engine exhaust 1005. Meanwhile, the lower two outlet valves 121 and 122 both remain closed. At this point, the low pressure vapor in second sub-chamber 107 drawn from the engine exhaust sink 1005 in Step 1 has been isolated. On the other hand, the third sub-chamber 108 of the right chamber 102 is now accessed to the low pressure vapor 120 from the engine exhaust sink 1005. Earlier, the pressure in fourth sub-chamber 106 on the right of diaphragm 104 was equal to or greater than the pressure in third sub-chamber 108. This allowed the diaphragm 104 to return to its natural, unstretched position as shown in FIG. 4B. The diaphragm 104 in the right chamber 102 is not shown as having moved depreciably to the right. Of course, the stretching of the right diaphragm 104 may have already begun because of the earlier injected high pressure vapor from boiler 1001 or from the inner coil boiler 237 would have already begun to cool. The cooling action is caused by condenser coil 110 located in the outer wall of the right chamber 102.

The lower left outlet valve 121 is opened by when the boiler pressure 138, accessed through the canal valve 129 located in the lower outlet valve 121, via first duct 154 opened by the diaphragm-actuated valve 140, and through the canal valve 118 location in the upper inlet valve 111, and tube section 151, acts on the end portion 127 of outlet valve 121. This brings us to Step 3.

Step 3

Figure 4C:
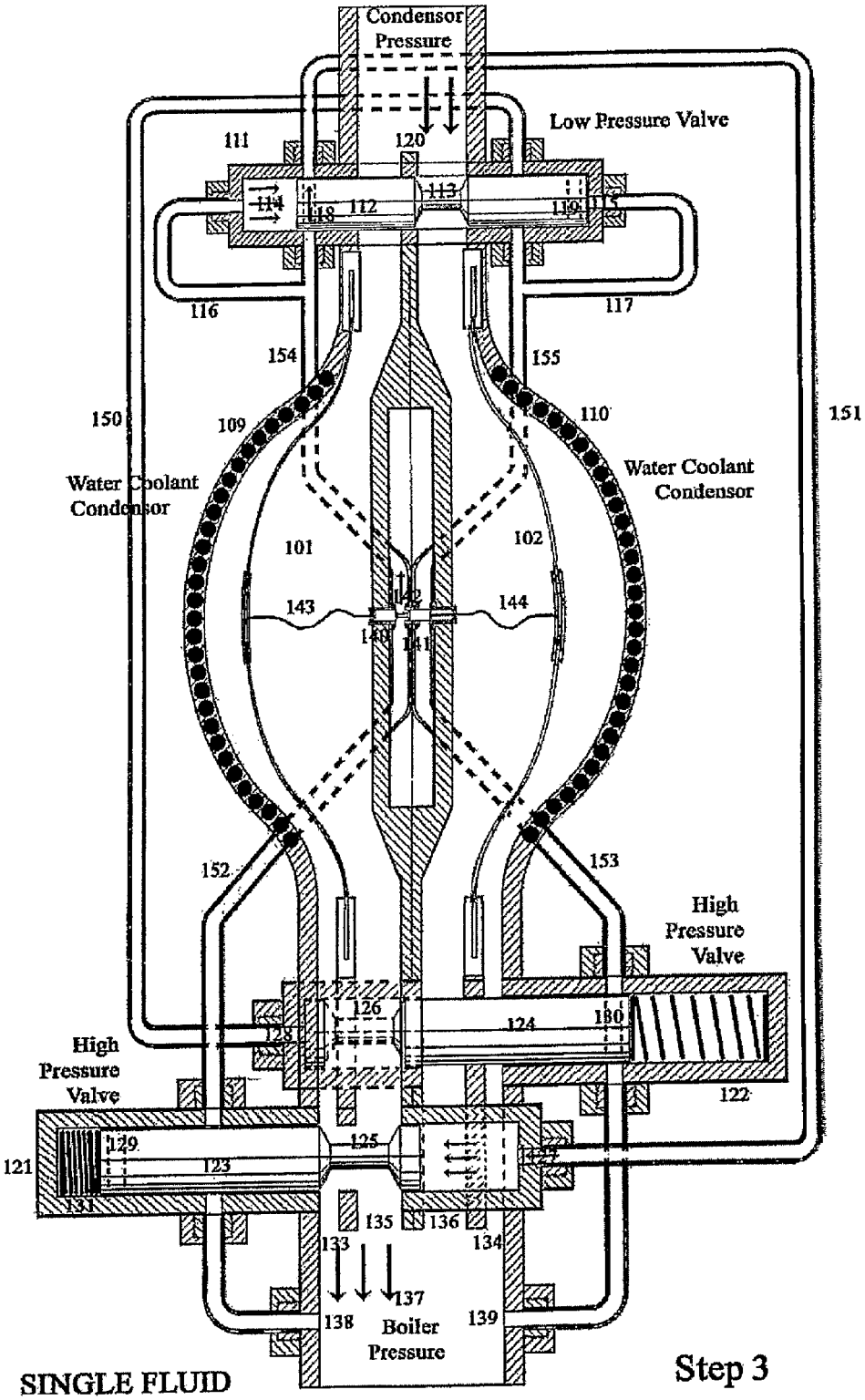

FIG. 4C shows that the lower left outlet valve 121 has just opened. The lower outlet valve 121 will be open only a few moments, just enough to allow the pressures on both sides of the diaphragm 103, i.e., in first sub-chamber 105 and second sub-chamber 107, to equalize so that the diaphragm 103 can retract back into its natural position, and for the previously captured low pressure vapor 120 from engine exhaust 1005 which was collected in the second sub-chamber 107 to mix with the high pressure vapor from boiler 1001, thus forcing almost all the mass of working fluid out of the second sub-chamber 107 into the boiler 1001. The canal port or hole 129 of the lower left outlet valve 121 is closed immediately when the outlet valve 121 opens. This action will cut off the boiler pressure 138 that is sustaining the lower left outlet valve 121 in its open position. As the high pressure 138 captured in first duct 154 cools, it will decrease in volume, allowing the return spring 131 in the lower left outlet valve 121 to close the outlet valve 121.

As the pressures on both sides of the diaphragm 103, i.e., in first sub-chamber 105 and second sub-chamber 107, are equalized allowing the diaphragm 103 to return back to its natural, unstretched position, the third sub-chamber 108 of the right chamber 102 is being filled with the low pressure vapor 120 from the engine exhaust sink 1005 by the suction action as the boiler vapor, which was injected into and trapped in fourth sub-chamber 106 in Step 2, is cooled by the condenser 110.

Step 4

Figure 4D:
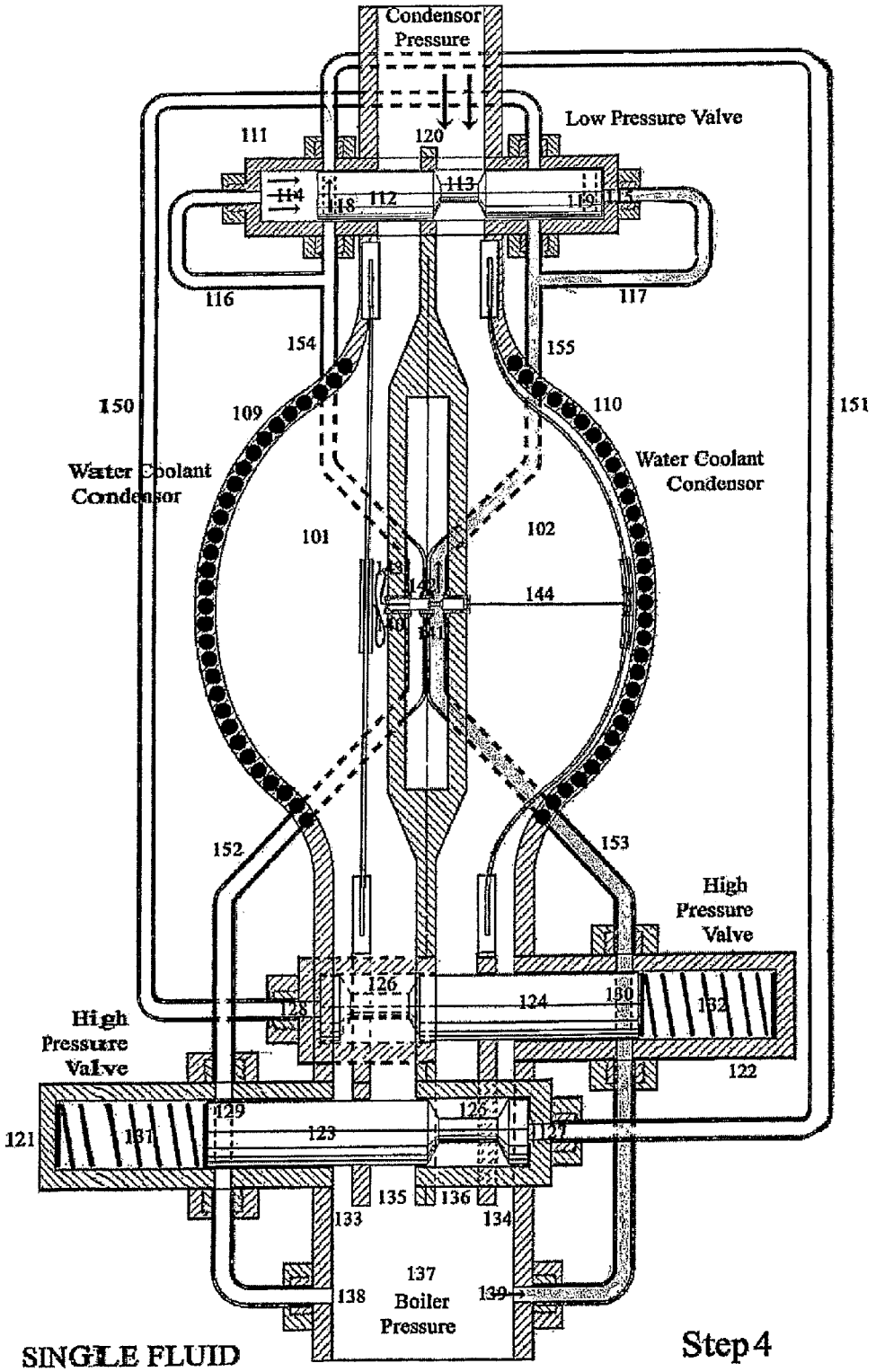

In FIG. 4D, the diaphragm 104 in the right chamber 102 pulls the diaphragm-actuated valve 140 to open second duct 155, which begins the same action in the right chamber 102 that had occurred in the left chamber 101 as described above.

Step 5

Figure 4E:
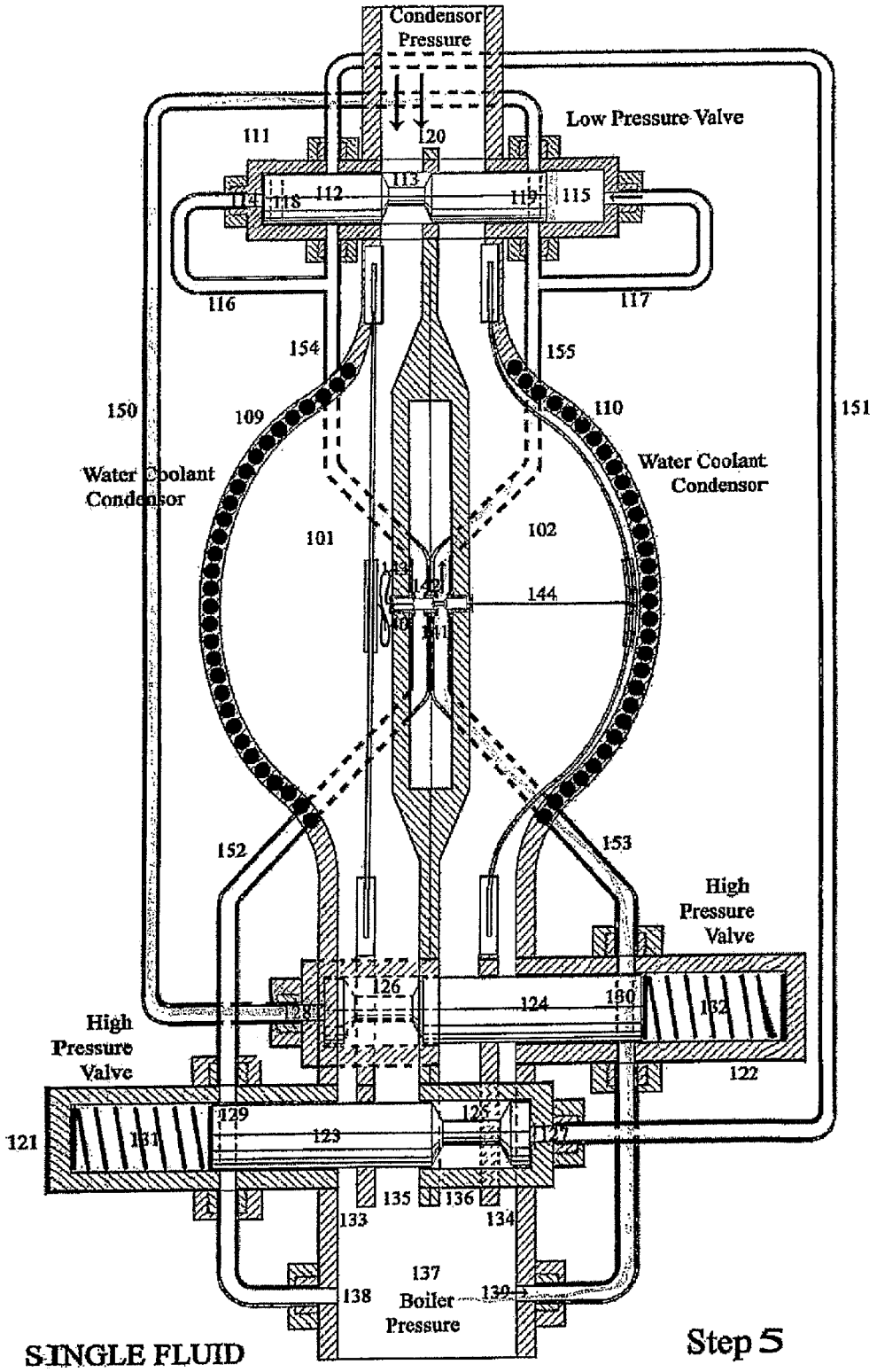

In FIG. 4E, the high boiler pressure 139 is now accessed through canal 130 of outlet valve 122, second duct 155 opened by diaphragm-activated control valve 140, to the right side 115 of the upper inlet valve 111, pushing the inlet valve 111 to the left, thus closing the right side (i.e., opening 4108) and opening the left side (i.e., opening 4107) or upper inlet valve 111 between the engine exhaust sink 1005 and the second sub-chamber 107.

The outlet valve 122 is opened by when the boiler pressure 139, accessed through the canal valve 130 located in the lower outlet valve 122, via second duct 155 opened by the diaphragm-actuated valve 140, and through the canal valve 119 located in the upper inlet valve 111, and tube section 150, acts on the end portion 128 of outlet valve 122. This brings us to Step 6.

Step 6

Figure 4F:
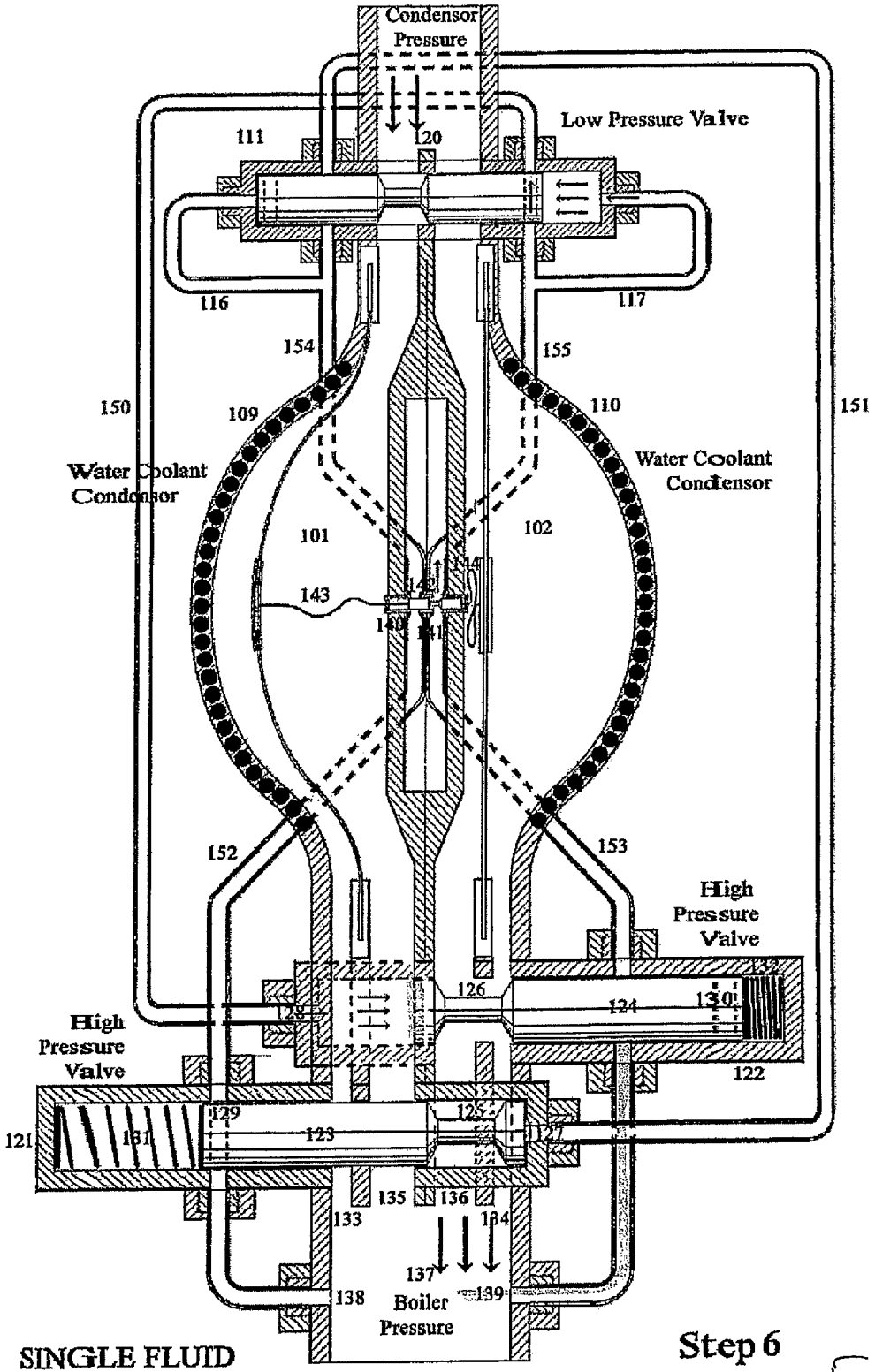

In FIG. 4F, outlet valve 122 has just opened, so that the third sub-chamber 108 can dump its captured low pressure vapor, that came from the engine exhaust sink 1005 in Step 4 and was trapped in Step 5, into the boiler 1001. The right diaphragm 104 moves back to its natural position as the pressure on each side of the diaphragm 104, i.e., in fourth sub-chamber 106 and third sub-chamber 108, equalize. As the diaphragm 104 returns back to its natural position, the collected low pressure vapor in the third sub-chamber 108 mixes with the high pressure vapor of boiler 1001 and dumps into the boiler 1001. The outlet valve 122 will be only temporarily open as discussed with respect to Step 3.

Step 7

Figure 4G:
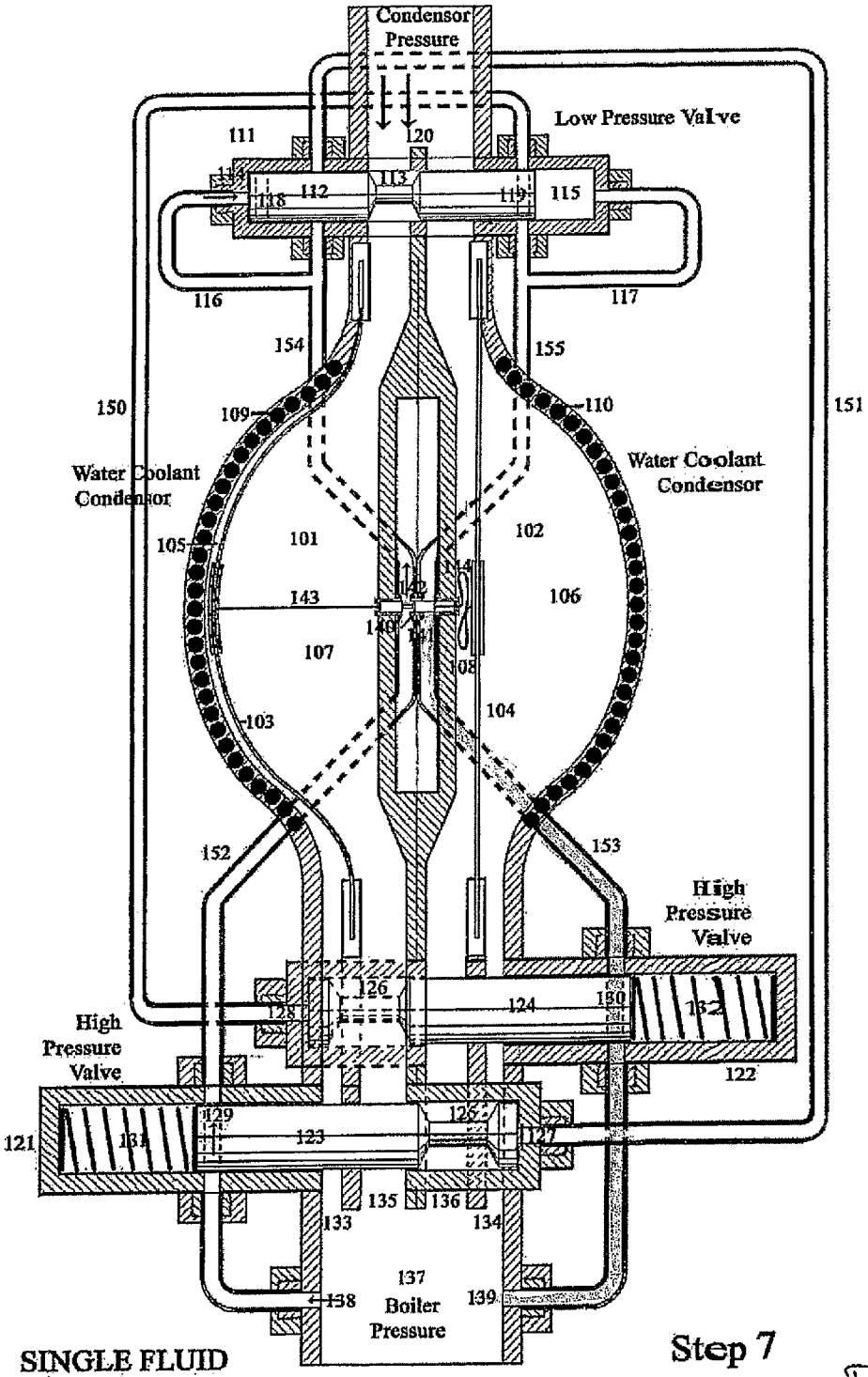

Step 7 is a return to Step 1. In FIG. 4G, the lower right outlet valve 122 closes as the boiler vapor 139 trapped in second duct 155, which is closed by control valve 140 activated by diaphragm 103, cools and condenses, allowing the spring 132 to push the outlet valve 122 to the left and to the closed position. The fluid pump 400 is now back in its position of Step 1, as shown in FIG. 4A.

In summary, the low pressure vapor 120 from the uniflow engine exhaust 1005 is pumped by fluid pump 400 into the high pressure boiler 1001 without a phase change. This pump 400 uses a suction means driven by the cooling of a hot vapor of a fluidic medium so as to create a smaller volume. This fluidic medium is located in the outer first sub-chamber 105 and fourth sub-chamber 106 behind the two diaphragms 103, 104 and next to the cooling coils 109, 110. A volume displacement in the cooled fluidic medium in first sub-chamber 105, fourth sub-chamber 106 behind the diaphragms 103 and 104 will cause the suction of the low pressure vapor 120 from the exhaust 1005 of the engine 1003 into respective second sub-chamber 107, third sub-chamber 108 the fluid pump 400. This suction is caused when the fluidic medium (such as helium or R134a) cools and contracts into a lesser volume, which in an embodiment can be a liquid volume, that must then be passed back into the boiler 1001. After the second sub-chamber 107 or third sub-chamber 108 is filled with the low pressure vapor 120, the low pressure vapor is next isolated and dumped into the boiler 1001.

It should be noted that fluid pump 400 of FIGS. 4A-4G corresponds to the single working fluid embodiment described with respect to FIG. 2. It is within the scope of the present invention to provide a further fluid pump which is similar to fluid pump 400 and corresponds to the double working fluid engine described with respect to FIG. 3. An example of such a further fluid pump is illustrated in FIG. 5.

Figure 5:
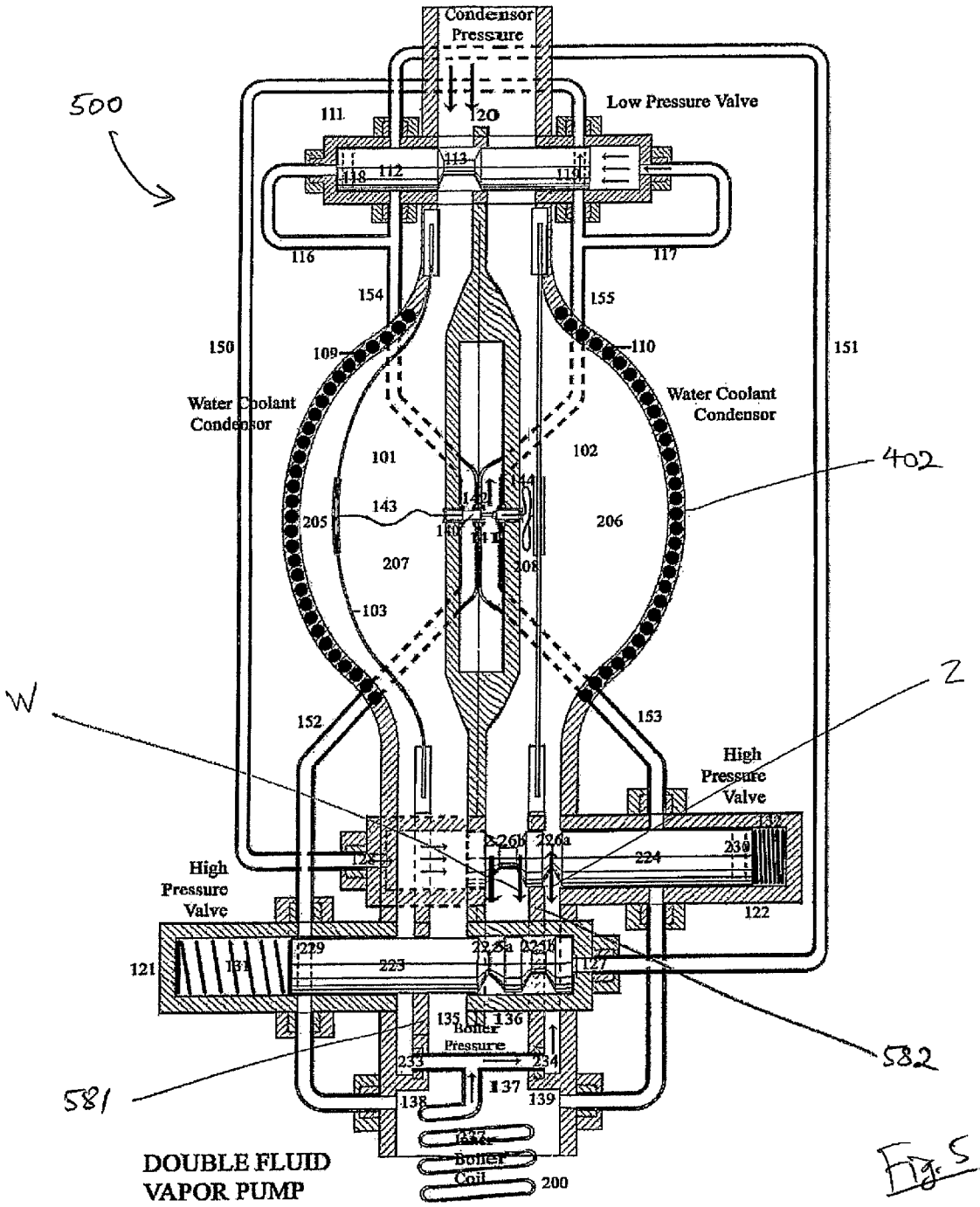
FIG. 5 is a cross sectional view of a fluid pump in accordance with a further embodiment.

Specifically, FIG. 5 is a cross sectional view of fluid pump 500 in a state similar to Step 6 of fluid pump 400 shown in FIG. 4F. The fluid pump 500 is similar to fluid pump 400 and like reference numerals denote like elements. The primary differences between fluid pump 400 and fluid pump 500 include inner coiler coil 237 and the configuration of the reduced cross section portions of outlet valves 121, 122.

In particular, inner coiler coil 237 plays the role of auxiliary boiler 3001 of FIG. 3. The fluidic medium of inner coiler coil 237 can be the same as of other than the working fluid of boiler 1001. The inner structure of chamber 402 now includes extension walls 581 and 582 which isolate the fluidic medium of inner coiler coil 237 from the working fluid of boiler 1001. Openings 233, 234 are formed in the extension walls 581, 582 to communicate inner coiler coil 237 only with first sub-chamber 105, fourth sub-chamber 106, and not with second sub-chamber 107 and third sub-chamber 108. The extension walls also isolate the boiler 1001 from first sub-chamber 105 and fourth sub-chamber 106, making sure that the fluidic medium of inner coiler coil 237 and the working fluid of 1001 will not be mixed, entering the "wrong" sub-chambers.

Further, the single reduced cross section portion 125, 126 of outlet valves 121, 122 of fluid pump 400 has been changed to include each two reduced cross section portions 225*a*, 225*b* and 226*a*, 226*b*. The reduced cross section portions 225*a*, 226*a*, when aligned with the respective lower openings of first sub-chamber 105, fourth sub-chamber 106 will allow the fluidic medium to enter the first sub-chamber 105, fourth sub-chamber 106 from inner coiler coil 237, as indicated by double-headed arrow Z in FIG. 5. Similarly, the reduced cross section portions 225*b*, 226*b*, when aligned with the respective lower openings or second sub-chamber chamber 107, third sub-chamber 108, will allow the working fluid to enter the second sub-chamber 107, third sub-chamber 108 from boiler 1001, as indicated by single-headed arrow W in FIG. 5. The reduced cross section portions 225*a*, 226*a* now play the role of valve 21052 of FIG. 3, whereas the reduced cross section portions 225*b*, 226*b* correspond to valve 21053.

The operation of fluid pump 500 is similar to fluid pump 400 and will not be repeated herein. It suffices to note that in the steps similar to Steps 3 and 6 of fluid pump 400 (FIGS. 4C and 4F), instead of the working fluid of boiler 1001 as described with respect to fluid pump 400, the fluidic medium of inner coiler coil 237 will enter the first sub-chamber 105, fourth sub-chamber 106 to provide the sub-chambers with new charges of high pressure vapor, and equalize the pressures between adjacent first sub-chamber 105, second sub-chamber 107 and between adjacent fourth sub-chamber 106, third sub-chamber 108.

In an embodiment, the fresh high pressure vapor of the fluidic medium coming in first sub-chamber 105, fourth sub-chamber 106 from inner coiler coil 237 may be at a higher pressure than the working fluid coming in second sub-chamber 107, third sub-chamber 108 from boiler 1001. As a result the diaphragms 103, 104 will be moved back to, and beyond the neutral position, as the first sub-chamber 105, fourth sub-chamber 106 expand and second sub-chamber 107, third sub-chamber 108 contract. This volume contraction of second sub-chambers 107, third sub-chamber 108, will move a larger mass of the trapped high pressure vapor from second sub-chamber 107, third sub-chamber 108 to boiler 1001. In addition, the higher pressure of the fluidic medium supplied by inner coiler coil 237 will ensure that, upon proper cooling, a greater suction force will be provided to draw a greater amount of the low pressure vapor from engine exhaust 1005 into second sub-chamber 107, third sub-chamber 108.

It is, however, within the scope of the present invention to provide the fluidic medium with a lower working pressure than the working fluid of boiler 1001, depending on application.

Figure 6:
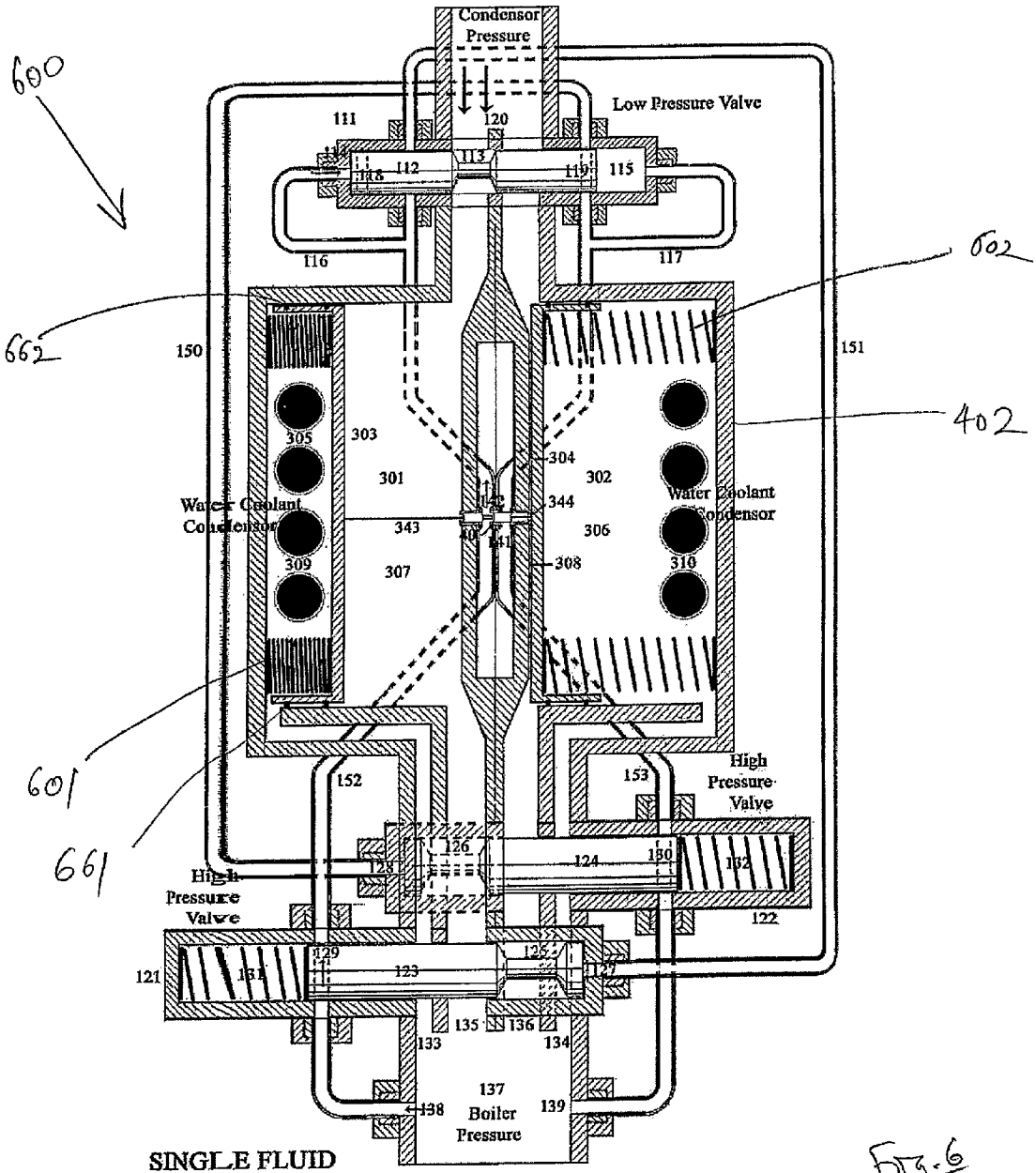
FIG. 6 is a cross sectional view of a fluid pump in accordance with a further embodiment.

FIG. 6 is a cross sectional view showing a fluid pump 600 in accordance with a further embodiment. Fluid pump 600 is similar in many aspects to fluid pumps 400 and 500, except that the diaphragms 103, 104 are now replaced with pistons 303, 304, biasing springs 601, 602 are added, and condenser coils now run within first sub-chamber 105, fourth sub-chamber 106 rather than in the wall of chamber 402. It is within the scope of the present invention to provide fluid pumps which include less than all three of the above listed changes.

Piston rings 661, 662 are provided to hermetically isolating first sub-chamber 105 from second sub-chamber 107, and fourth sub-chamber 106 from third sub-chamber 108. Pistons 303, 304 can be free pistons, meaning that their movements are dictated only by the pressure difference between the adjacent sub-chambers, i.e., 105, 107 and 106, 108. In this arrangement, the pistons function similar to diaphragms 103, 104.

However, pistons 303, 304 can also be driven or biased by biasing springs 601, 602. The biasing springs 601, 602 bias the respective pistons 303, 304 towards the center of the device, i.e., in the directions of compressing the second sub-chamber 107, and third sub-chamber 108. This arrangement will have an effect similar to the effect of the over-pressurized fluidic medium described above with respect to fluid pump 500, i.e., the biased pistons will further compress the respective second sub-chamber 107, third sub-chamber 108 in the steps similar to Steps 3 and 6 of fluid pump 400 (FIGS. 4C, 4F) to move a larger mass of the trapped high pressure vapor from the respective second sub-chamber 107, third sub-chamber 108 to boiler 1001. In an embodiment exemplarily illustrated in FIG. 6, the volume of third sub-chamber 108 is compressed maximally by spring 602, thereby forcibly expelling a substantial portion, if not all, of the working fluid vapor out of third sub-chamber 108 and into boiler 1001. As a result, any residual pressure left in third sub-chamber 108 after the closing of outlet valve 122 will be minimal, and the likelihood that the residual vapor will flow back into the condenser sink or engine exhaust 1005 upon the opening of the upper opening 4108 of third sub-chamber 108 by inlet valve 111 will be significantly reduced.

Finally, the arrangement of condenser coils 309, 310 within the first sub-chamber 105, fourth sub-chamber 106 will enhance the cooling effect. The presence of biasing springs 601, 602 will also prevent pistons 303, 304 from hitting and subsequently damaging the condenser coils 309, 310.

The operation of fluid pump 600 is similar to fluid pumps 400, 500 and will not be repeated herein.

It should be noted that fluid pump 600 can be modified to use separate working fluids for the cooling sub-chambers, i.e., first sub-chamber 105, fourth sub-chamber 106, and for the pumping sub-chambers, i.e., second sub-chamber 107, third sub-chamber 108.

Figure 7:
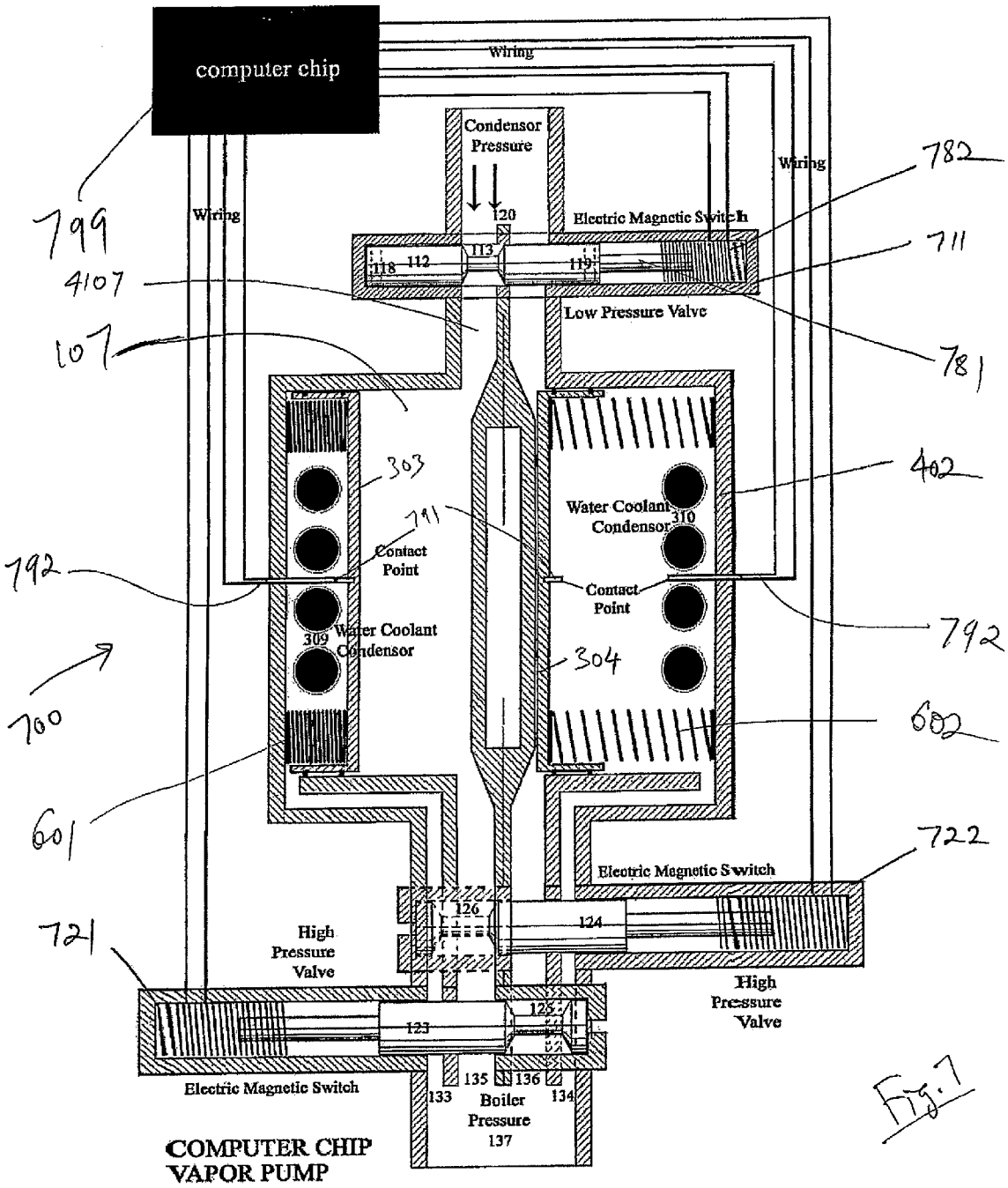
FIG. 7 is a schematically cross sectional view of a fluid pump in accordance with a further embodiment.

FIG. 7 is a schematically cross sectional view of a fluid pump 700 in accordance with a further embodiment. In fluid pump 700, the previously described pneumatically driven valves, such as 111, 121, 122, are replaced with electrically driven valves 711, 721, 722. Furthermore, the control valve 140 and associated first duct 154, second duct 155 are omitted and the function of valve control mechanism 2107 is performed by an electronic controller 799 which is either programmed or hardwired to properly control the closing/opening of the valves 711, 721, 722.

In particular, each of the valves 711, 721, 722 now includes a magnetically attractable element, e.g., 781, attached to its valve body, e.g., 112. Each valve further has an electro-magnetic coil, e.g., 782 for interaction with the magnetically attractable element 781. The current flowing to coil 782 is controlled by controller 799 via appropriate wirings. The coil 782 can both attract and repel the magnetically attractable element 781, in which case the return springs, e.g., 4122, 4121, can be omitted. However, if coil 72 can only attract (or repel) the magnetically attractable element 781, such return springs will be required to return the respective valve to the original position.

Although the valves 711, 721, 722 in fluid pump 700 are described above as being magnetically driven, other arrangements in which the valves are driven mechanically and/or electrically, e.g., by ways of motors, are not excluded.

The above discussed canal-lock principles of controlling the valves are also applicable to controller 799. In particular, controller 799 is programmed or hardwired to never open both inlet and outlet valves of each of second sub-chamber 107, third sub-chamber 108 at the same time. Further, the timing for opening each valve is synchronized with the positions of the respective partitioning member or piston 303, 304.

For example, the leftmost position of piston 303, which corresponds to the activation of control valve 140 and the subsequent closing of the upper opening of second sub-chamber 107 in fluid pump 400 (FIGS. 4A, 4B), is used in fluid pump 700 to trigger controller 799 to move inlet valve 711 accordingly, thereby closing the upper opening of second sub-chamber 107. For this purpose, an electric contact switch 792 and a corresponding probe 791 are provided on the wall of the chamber 402 and piston 303, respectively. When probe 791 contacts the respective electric contact switch 792 at the leftmost position of piston 303, the electric contact switch 792 is actuated and caused to signal controller 799 that it is time to close the upper opening 4107 of second sub-chamber 107. In further embodiments, a position sensor which is magnetically and/or optically and/or mechanically actuable and located near the leftmost position of piston 303 can be used as an alternative to the switch/probe arrangement.

In the pneumatic valves 121, 122, the closing of the valves is effected by returning springs 4121, 4122 which overcome the high pressure of the working fluid which is trapped in the respective first duct 154, second duct 155 and begins to cool. The valve closing timing therefore depends on the parameters of the high pressure vapor of the working fluid and how fast the trapped working fluid vapor cools. This introduces some uncertainty into the operation the pneumatic valves. In contrast, the controller 799 can time the exact time period during which the outlet valves 121, 122 can be opened, using an internal or external timer which will begin to count upon the opening of the respective outlet valves.

As discussed above, the outlet valves of first sub-chamber 105 and second sub-chamber 107, as well as the outlet valves of fourth sub-chamber 106 and third sub-chamber 108, can be independently controlled and driven. This can be done in a fluid pump similar to fluid pump 700 with each of the outlet valves 721, 722 closing only the outlets of the second sub-chamber 107, third sub-chamber 108, and additional outlet valves being added to be controlled by controller 799 and closing only the outlets of the first sub-chamber 105, fourth sub-chamber 106. Thus, the outlets of, e.g., first sub-chamber 105 and second sub-chamber 107, can be opened at different timings, rather than simultaneously. Fox example, the outlet valve 721 of second sub-chamber 107 can be opened first to dump most of the mass of the trapped low pressure vapor to boiler 1001, and then the independently controlled outlet valve (not shown) of the first sub-chamber 105 is opened to push, by the pressure action of the high pressure vapor from boiler 1001 or inner coiler coil 237 plus the spring action of biasing springs 601, the respective piston 303 to its rightmost position, thereby substantially expelling the entire working fluid from second sub-chamber 107 into boiler 1001. The delay between the opening of the outlet valves of the first sub-chamber 105 and second sub-chamber 107 can be easily configured/controlled/adjusted by controller 799.

It is within the scope of the present invention to provide a fluid pump with more than two associated pump arrangements (such as 101, 102, described above with respect to fluid pump 400) each corresponding to one of the configurations shown in FIGS. 2-3. In a multi-pump-arrangement configuration, controller 799 can be programmed or hardwired to regulate the closing and opening of the valves of all pump arrangements as a centralized valve control.

FIG. 8 is a schematically cross sectional view showing a compact configuration of a fluid pump 800 in accordance with a further embodiment. Fluid pump 800 of FIG. 8 is similar to the fluid pump 600 of FIG. 6, and shows the inlet and outlet valves 111, 121, 122 as seen along their axial direction. As can be seen in FIG. 8, the valves are located adjacent the respective openings of the respective sub-chambers, therefore resulting in a compact configuration. It is within the scope of the present invention to arrange the valves of fluid pump 700 of FIG. 7 in the manner shown in FIG. 8 to provide a compact fluid pump (not shown) using an electronic controller.

While the foregoing disclosure shows illustrative embodiments, it should be noted that various changes and modifications could be made herein without departing from the scope of the described embodiments as defined by the appended claims. Furthermore, although elements of the described embodiments may be described or claimed in the singular, the plural is contemplated unless limitation to the singular is explicitly stated.

The invention claimed is:

1. A fluid pump for moving a fluid from a first fluid source of said fluid in a low pressure state to a second fluid source of said fluid in a high pressure state, said fluid pump comprising:

a chamber;

a partitioning member displaceable in said chamber and dividing said chamber into first and second sub-chambers of varying volumes;

said first sub-chamber having an opening controllably communicable with either the second fluid source or a third fluid source;

said second sub-chamber having inlet and outlet openings controllably communicable with the first and second fluid sources, respectively; and a cooling element for cooling a fluid in said first sub-chamber;

wherein said pump is a vapor pump utilizing the Stirling Cycle to forcibly move low pressure vapor of said fluid from the first fluid source to the second fluid source without a vapor-liquid phase change.

2. The fluid pump of claim 1, wherein said cooling element operatively cools the fluid in said first sub-chamber, thereby reducing the fluid pressure in said first sub-chamber and causing the partitioning member to move towards the first sub-chamber and to create a suction in said second sub-chamber for drawing the low pressure fluid from the first fluid source into said second sub-chamber when the inlet opening of said second sub-chamber is operatively open; and when the inlet opening of said second sub-chamber is operatively closed, said outlet opening of said second sub-chamber is operatively open for moving the low pressure fluid from said second sub-chamber into said second fluid source.

3. The fluid pump of claim 1, wherein said partitioning member is a diaphragm moveable by a pressure difference between said sub-chambers.

4. The fluid pump of claim 1, wherein said partitioning member is either a free piston moveable only by a pressure difference between said sub-chambers or a piston biased towards said second sub-chamber.

5. The fluid pump of claim 1, further comprising valves for controllably closing and opening the inlet and outlet openings of said second sub-chamber and the opening of said first sub-chamber.

6. The fluid pump of claim 5, wherein at least one of said valves is driven by the fluid pressure of at least one of said fluid sources.

7. The fluid pump of claim 5, wherein at least one of said valves is driven independently of the fluid pressures of said fluid sources, and in at least one of electrical, magnetic, and mechanical manners.

8. A fluid pump for moving a fluid from a first fluid source of said fluid in a low pressure state to a second fluid source of said fluid in a high pressure state, said fluid pump comprising:

a chamber;

a partitioning member displaceable in said chamber and dividing said chamber into first and second sub-chambers of varying volumes;

said first sub-chamber having an opening controllably communicable with either the second fluid source or a third fluid source;

said second sub-chamber having inlet and outlet openings controllably communicable with the first and second fluid sources, respectively; and a cooling element for cooling a fluid in said first sub-chamber;

wherein said opening of said first sub-chamber is communicable with said second fluid source; and when said opening of said first sub-chamber and said outlet opening of said second sub-chamber are operatively open and said inlet opening of said second sub-chamber is operatively closed, the fluid pressures in said sub-chambers are equalized with the fluid pressure of the second fluid source, thereby moving said partitioning member towards said second sub-chamber.

9. A fluid pump for moving a fluid from a first fluid source of said fluid in a low pressure state to a second fluid source of said fluid in a high pressure state, said fluid pump comprising:

a chamber;

a partitioning member displaceable in said chamber and dividing said chamber into first and second sub-chambers of varying volumes;

said first sub-chamber having an opening controllably communicable with either the second fluid source or a third fluid source;

said second sub-chamber having inlet and outlet openings controllably communicable with the first and second fluid sources, respectively; and a cooling element for cooling a fluid in said first sub-chamber;

wherein said opening of said first sub-chamber is communicable with a third fluid source isolated from the second fluid source; and when said opening of said first sub-chamber and said outlet opening of said second sub-chamber are operatively open and said inlet opening of said second sub-chamber is operatively closed, a difference in fluid pressure in said sub-chambers is such that said partitioning member is moved towards said second sub-chamber.

10. A fluid pump for moving a fluid from a first fluid source of said fluid in a low pressure state to a second fluid source of said fluid in a high pressure state, said fluid pump comprising:

first and second chambers;

a first partitioning member displaceable in said first chamber and dividing said first chamber into first and second sub-chambers of varying volumes;

a second partitioning member displaceable in said second chamber and dividing said second chamber into third and fourth sub-chambers of varying volumes;

each of said first and fourth sub-chambers having an opening controllably communicable with either the second fluid source or a third fluid source;

each of said second and third sub-chambers having inlet and outlet openings controllably communicable with the first and second fluid sources, respectively; and a cooling element for cooling a fluid in said first and fourth sub-chambers, thereby reducing the fluid pressures in said first and fourth sub-chambers and creating suctions in said second and third sub-chambers, respectively, for drawing the low pressure fluid from said first fluid source into said second and third sub-chambers, respectively;

wherein said first fluid source is at all times in fluid communication with at least one of the second and third sub-chambers via the respective inlet openings, whereby the low pressure fluid is substantially continuously drawn out of the first fluid source;

said fluid pump further comprising an inlet valve for alternatively closing the inlet openings of said second and third sub-chambers;

said inlet valve being moveable between a first position, at which said inlet valve opens the inlet opening of the second sub-chamber and closes the inlet opening of the third sub-chamber, and a second position, at which said inlet valve closes the inlet opening of the second sub-chamber and opens the inlet opening of the third sub-chamber.

11. The fluid pump of claim 10, wherein said first and second partitioning members are operatively coupled to control said inlet valve, thereby closing the inlet openings of the second and third sub-chambers, respectively, when said second and third sub-chambers have expanded to a predetermined volume defined by displacement of said first and second partitioning members, respectively, towards said first and fourth sub-chambers, respectively.

12. The fluid pump of claim 11, wherein said inlet valve is operatively coupled to control outlet valves at the outlet openings of said second and third sub-chambers, thereby opening the respective outlet valves of the second and third sub-chambers after the closings of the respective inlet openings of said second and third sub-chambers.

13. The fluid pump of claim 12, further comprising a control valve for alternatively closing first and second ducts communicating the second fluid source to opposite sides of said inlet valve;

said control valve being operatively coupled to said partitioning members;

when said second sub-chamber has expanded to the predetermined volume, said control valve being moveable by said first partitioning member to a third position at which said control valve opens the first duct and closes the second duct, thereby accessing the fluid pressure from said second fluid source to only one of the opposite sides of the inlet valve and, hence, moving the inlet valve from the first position to the second position to close the inlet opening of said second sub-chamber and open the inlet opening of said third sub-chamber; and when said third sub-chamber has expanded to the predetermined volume, said control valve being moveable by said second partitioning member to a fourth position at which said control valve opens the second duct and closes the first duct, thereby accessing the fluid pressure from said second fluid source to only the other of the opposite sides of the inlet valve and, hence, moving the inlet valve from the second position to the first position to close the inlet opening of said third sub-chamber and open the inlet opening of said second sub-chamber.

14. The fluid pump of claim 13, wherein when said inlet valve is in the second position, said inlet valve communicates the first duct to a third duct leading to the outlet valve of said second sub-chamber, thereby accessing the fluid pressure of said second fluid source via said control valve, said first duct and said third duct to open the outlet valve of said second sub-chamber which, in turn, causes the low pressure fluid trapped in said second sub-chamber to be moved to the second fluid source; and when said inlet valve is in the first position, said inlet valve communicates the second duct to a fourth duct leading to the outlet valve of said third sub-chamber, thereby accessing the fluid pressure of said second fluid source via said control valve, said second duct and said fourth duct to open the outlet valve of said third sub-chamber which, in turn, causes the low pressure fluid trapped in said third sub-chamber to be moved to the second fluid source.

15. The fluid pump of claim 14, wherein when the outlet valve of said second sub-chamber is opened, the opening of said first sub-chamber is also opened, thereby replacing the cooled fluid in said first sub-chamber with a new charge of fluid at a higher temperature and/or pressure and causing the first partitioning member to move towards the second sub-chamber; and when the outlet valve of said third sub-chamber is opened, the opening of said fourth sub-chamber is also opened, thereby replacing the cooled fluid in said fourth sub-chamber with a new charge of fluid at a higher temperature and/or pressure and causing the second partitioning member to move towards the third sub-chamber.

16. The fluid pump of claim 15, further comprising returning mechanisms for closing the outlet openings of said second and third sub-chambers and the openings of said first and fourth sub-chambers after a predetermined time period.

17. The fluid pump of claim 16, wherein, the control valve is connected to said partitioning members by strings, said returning mechanisms comprise springs, and said inlet valve and outlet valves comprise pneumatically driven valves.

18. The fluid pump of claim 17, wherein the first and second partitioning members are pistons biased to compress the second and third sub-chambers, respectively.

19. The fluid pump of claim 12, further comprising at least a sensor for alternatively generating an electric signal upon detecting that said second and third sub-chambers have expanded to the predetermined volume;

an electronic controller coupled to control the inlet valve and the outlet valves, and operatively responsive to said signal to alternatively close the inlet openings of the second and third sub-chambers to trap the low pressure fluid drawn from said first fluid source in said second and third sub-chambers; and a timer for causing said controller to alternatively open the outlet openings of the second or third sub-chambers after a predetermined time has lapsed since the closing of the respective inlet openings, thereby moving the trapped low pressure fluid to the second fluid source.

20. The fluid pump of claim 19, said controller being further operable to alternatively open the openings of said first and fourth sub-chambers for replacing the cooled fluid in said first and fourth sub-chambers with new charges of fluid at a higher temperature and/or pressure and causing the first and second partitioning members to return to compress the second and third sub-chambers, respectively.

21. A system, comprising:

a boiler for supplying a high pressure fluid;

an engine coupled to said boiler, running on said high pressure fluid, and exhausting said fluid in a low pressure state; and a fluid pump for returning the low pressure fluid from the engine exhaust to said boiler, said fluid pump comprising:

a chamber;

a partitioning member displaceable in said chamber and dividing said chamber into first and second sub-chambers of varying volumes;

said first sub-chamber having an opening controllably communicable with the boiler;

said second sub-chamber having inlet and outlet openings controllably communicable with the engine exhaust and the boiler, respectively; and a cooling element cooling a fluid in said first sub-chamber, thereby reducing the fluid pressure in said first sub-chamber and creating a suction in said second sub-chamber for drawing the low pressure fluid from said engine exhaust into said second sub-chamber from which said low pressure fluid is further moved to said boiler upon opening of said outlet opening.

22. A method of pumping a fluid from a first fluid source of said fluid in a low pressure state to a second fluid source of said fluid in a high pressure state, said method comprising:

providing a chamber having a partitioning member displaceable therein and dividing said chamber into first and second sub-chambers of varying volumes;

cooling a fluidic medium in said first sub-chamber to reduce a pressure in said first chamber, causing the partitioning member to move to expand the second sub-chamber thereby generating a suction in the second sub-chamber;

communicating said second sub-chamber with the first fluid source, thereby drawing the low pressure fluid into said second sub-chamber by the generated suction;

isolating the second sub-chamber from said first fluid source and then communicating the second sub-chamber with the second fluid source, thereby causing the drawn low pressure fluid to move to the second fluid source without a phase change; and replacing the cooled fluidic medium in said first sub-chamber with a new charge of said fluidic medium at a higher temperature and/or pressure, thereby causing the partitioning member to move to compress the second sub-chamber and ready for a subsequent pumping cycle.

* * * * *